US007478738B2

(12) United States Patent
Hood et al.

(10) Patent No.: US 7,478,738 B2
(45) Date of Patent: Jan. 20, 2009

(54) TRIGGER SPRAYERS

(75) Inventors: Oliver Hood, Edenderry (IE); Elizabeth Jones, legal representative, Edenderry (IE); Edward McCloskey, Drogheda (IE)

(73) Assignee: Edmak Limited, Drogheda, County Louth (IE)

( * ) Notice: Subject to any disclaimer, the term of this patent is extended or adjusted under 35 U.S.C. 154(b) by 529 days.

(21) Appl. No.: 10/483,487

(22) PCT Filed: Jul. 15, 2002

(86) PCT No.: PCT/IE02/00102

§ 371 (c)(1),
(2), (4) Date: Jan. 31, 2005

(87) PCT Pub. No.: WO03/006174

PCT Pub. Date: Jan. 23, 2003

(65) Prior Publication Data

US 2005/0167527 A1 Aug. 4, 2005

(30) Foreign Application Priority Data

Jul. 13, 2001 (IE) ..... S2001/0658

(51) Int. Cl.
*B67D 5/40* (2006.01)

(52) U.S. Cl. ..... 222/383.1; 239/333

(58) Field of Classification Search ..... 222/383.1, 222/143, 527, 528–537, 383.3, 142, 628, 222/257, 321.7–321.9, 324; 239/337, 333
See application file for complete search history.

(56) References Cited

U.S. PATENT DOCUMENTS

| | | | | | |
|---|---|---|---|---|---|
| 4,236,655 | A | * | 12/1980 | Humphries | 222/465.1 |
| 4,351,454 | A | * | 9/1982 | Maynard, Jr. | 222/143 |
| 4,881,647 | A | | 11/1989 | Schiemann | 206/510 |
| 4,925,066 | A | * | 5/1990 | Rosenbaum | 222/129 |
| 5,100,058 | A | * | 3/1992 | Wei | 239/273 |
| 5,170,910 | A | * | 12/1992 | Hamm | 222/92 |
| 5,601,211 | A | * | 2/1997 | Foster | 222/143 |
| 5,651,908 | A | * | 7/1997 | Mansfield | 222/530 |
| 6,270,715 | B1 | * | 8/2001 | Mayfield | 264/506 |

FOREIGN PATENT DOCUMENTS

| | | |
|---|---|---|
| CH | 603410 | 8/1978 |
| EP | 0674948 A1 | 10/1995 |
| FR | 2565315 | 12/1985 |
| WO | WO92/04236 | 3/1992 |

OTHER PUBLICATIONS

Patent Abstracts of Japan, vol. 1997, No. 07, Jul. 31, 1997 & JP 09057159A (Takehara:KK), Mar. 4, 1997.
Patent Abstracts of Japan, vol. 1999, No. 12, Oct. 29, 1999 & JP 11189238A (Nippon Baazu KK), Jul. 13, 1999.

* cited by examiner

*Primary Examiner*—Lien T Ngo
(74) *Attorney, Agent, or Firm*—Jacobson Holman PLLC

(57) ABSTRACT

A trigger spray assembly (1) has generally cubic container (2) with a trigger sprayer (3) mounted thereon. The trigger sprayer (3) is mounted offset form the centre of the container (2) to allow stacking of mutually inverted containers (2). A top (4) of the container (2) in combination with an uppermost surface of the trigger sprayer (3) forms a support surface for reception and support of another container (2) stacked thereon. Container (2) is space efficient, stable, and allows stacking.

28 Claims, 27 Drawing Sheets

TRIGGER SPRAYERS

This is a nationalization of PCT/1E02/00102 filed Jul. 15, 2002 and published in English.

The present invention relates to a liquid spray dispenser of the type comprising a container with a trigger sprayer mounted on the container and communicating with an interior of the container for dispensing liquid from the container.

BACKGROUND OF THE INVENTION

Such containers and trigger sprayers are used extensively for the dispensing of cleaning liquids. Typically, the containers provided are relatively tall having a body which narrows at the top into an elongated neck which forms a handgrip with the trigger sprayer being mounted at the top of the neck. This is a very convenient and useful form of dispenser. However, there are certain problems. One of the major problems is the actual construction of container themselves which are generally unstable due to their relatively tall shape and can easily be knocked over, particularly when the container is less than half full of liquid. All these containers are manufactured from relatively lightweight plastics material, as cost of packaging is a major consideration. The trigger sprayer is generally relatively much heavier and thus the containers are unstable and they become particularly unstable as they are emptied.

This instability, while inconvenient for the consumer, is a major problem in retail outlets where the display of the containers is relatively difficult on shelving in that they tend to be knocked over by the customers and further, they cannot be stacked one on top of the other for display purposes. Because of their general shape, the actual volume conventional dispenser incorporating such trigger sprayers occupy is a space of the order of 2.5 times the actual usable volume of the content. Thus, they are relatively costly for the retailer to display. A further problem is that since they cannot be stacked one on top of the other, the packing of them for transport is equally costly and space consuming.

SUMMARY OF THE INVENTION

According to the invention there is provided a trigger spray container assembly of the type comprising a container with a trigger sprayer mounted on the container and communicating with an interior of the container for dispensing liquid from the container, characterized in that the container has a generally parallelepiped shape in which the ratio of the width of a base of the container at its narrowest point to the height of the container is in the range 2:1 to 1:3.

In one embodiment of the invention the ratio of the width of the base at its narrowest point to the height of the container is about 1:1.

In another embodiment the container has a substantially cubic shape.

In a further embodiment the ratio of the cross sectional area of the base to the cross-sectional area of a side wall of the container is in the range 2:1 to 1:2. Said ratio may conveniently be about 1:1.

In another embodiment the volume of the container relative to the spatial volume occupied by the container, said spatial volume being defined by an imaginary parallelepiped inside faces of which touch corresponding external side faces of the container is greater than 60%. Preferably the relative volume is greater than about 75%. In some cases the relative volume may be greater than 90%.

According to one embodiment of the invention there is provided a trigger sprayer container assembly of the type comprising a container with a trigger sprayer mounted on the container and communicating with an interior of the container for dispensing liquid from the container wherein a top surface of the container in combination with an uppermost surface of a trigger sprayer together form a support surface for reception and support of another container stacked thereon.

In another embodiment the uppermost surface of the trigger sprayer is substantially flush with the top surface of the container.

In another embodiment the trigger sprayer is mounted at one side of the container.

In a further embodiment the trigger sprayer is mounted within a stepped recess in an upper portion of the container. The trigger sprayer may be mounted in an upright orientation within the recess or may be mounted in a generally horizontal orientation in the recess.

In another embodiment the trigger sprayer is mounted at a top of the container offset from a centre of the top of the container sufficiently to allow stacking of a pair of mutually inverted container assemblies with said trigger sprayers resting side by side and the trigger sprayer on each container engaging the top of the other adjacent container.

In a further embodiment of the trigger sprayer is mounted at a top of the container and means for mounting the trigger sprayer on the container is provided which supports a spray head of the trigger sprayer in a substantially horizontal position extending across and spaced-above the top of the container. Thus advantageously the container is very space efficient. It will also be stable even when there is relatively little liquid within the container.

In another embodiment the container has a lower portion and an upper portion extending upwardly off the lower portion and defining with the lower portion a recess within which the trigger spray is mounted with an uppermost portion of the trigger sprayer being substantially flush with a top up of the upper portion of the container.

In another embodiment the container is generally L-shaped in cross-section, the upper portion extending upwardly at one side of the lower portion of the container.

In another embodiment the trigger sprayer is mounted on a top surface of the lower portion of the container and is spaced-apart from an upstanding side wall of the upper portion sufficiently to allow insertion and through passage of the fingers or thumb of a person's hand for gripping the trigger sprayer.

In another embodiment the trigger sprayer is mounted on the top surface of the lower portion of the container closely adjacent to the upstanding side wall of the upper portion so that in use a user grips both the trigger sprayer and the upper portion when using the trigger sprayer.

According to another aspect of the invention there is provided a trigger sprayer for mounting externally of an aperture in a liquid container of the type comprising a spray head body mounting a spray nozzle, a liquid pump operated by a reciprocal trigger and a container tube connecting the pump to the lowermost portion in use of the container and means for mounting the trigger sprayer in the container characterized in that the spray head body is foldable about itself to and from a spraying position proud of the container. By folding the trigger sprayer about itself, the whole overall height of the dispenser formed by the container and the trigger sprayer is reduced and thus less shelf space is required. Further, they may be stacked one on top of the other.

In one embodiment of the invention, hinge mean connects the spray head body and the means for mounting the trigger on the container.

In one embodiment of the invention, the hinge means is provided by a concertina shaped neck portion on the spray head body. This is a particularly easy type of hinge to produce which will be relatively efficient. A hinge may also be provided by using an elastic material which may be stretched and bent.

Further, in another embodiment of the invention, the hinge comprises:

a cylindrical body having a diametrically arranged delivery bore;

a rotatable sleeve surrounding in liquid-tight manner the cylindrical body;

the sleeve mounting the spray head and being connected to the pump by a conduit terminating in a hole in the sleeve forming a conduit entrance;

a hole in the sleeve diametrically opposed to the conduit entrance forming a container exit, the container tube having a liquid-tight sleeve engaging mouth whereby, with the conduit entrance container exit and delivery bore in line, the trigger sprayer is in the spraying position and pivotal movement of the trigger sprayer out of the position closes the delivery bore.

This is a particularly suitable arrangement as a relatively inexpensive hinge can be provided which will have the added advantage that when pivoted out of position, it also acts as a closure and would be an additional closure over and above that provided by the sprayer itself.

Further, the invention provides a liquid container for mounting a trigger sprayer of the type hereinbefore described in which the container has a top wall, a bottom wall, side walls and a neck portion upstanding form the top wall for reception of the trigger sprayer and in which the top wall has a recess to receive the trigger sprayer when folded.

Further, the invention provides a liquid container for mounting a trigger sprayer of the type hereinbefore described in which the container has a top wall, a bottom wall and side walls and a neck portion upstanding from top wall for reception of the trigger sprayer and in which the bottom wall has a recess to receive the trigger sprayer, when folded, of another container when the other container is stacked on it. It will be appreciated therefore, that these two latter constructions of container will allow stacking of containers in a supermarket which will be particularly efficient for the retailer. They will also allow the consumer to store the containers in a much more stable way.

In this latter embodiment of the invention, the recess may include clip means for releasably holding the trigger sprayer in the folded position. Such clip means could be, for example, provided by protuberances integral with the container and since such containers are generally manufactured from a plastics material and are of relatively thin wall, the natural resilience of the plastics material will be sufficient to hold the trigger sprayer in position.

Further, the invention provides a liquid container for mounting a trigger sprayer of the type comprising a spray head body mounting a spray nozzle, a liquid pump operated by a reciprocal trigger, and a container tube connecting the pump to the lowermost portion in use of the container, and means for mounting the trigger sprayer on the container characterized in that the container comprises a container body having a neck portion for reception of the means for mounting the trigger sprayer and the neck portion is foldable about itself to move the trigger sprayer from a spraying position proud of the container to a folded position against the container.

The great advantage of this type of container is that conventional trigger sprayers can be mounted in the container.

In one embodiment of the invention, the liquid container is so arranged that the hinge means are mounted between the neck portion and the container body.

In another embodiment of the invention, the hinge means is incorporated in the neck portion. When the hinge means is incorporated in the neck portion, the hinge means can be provided by concertina-like formations in the neck portion or by a stretchable pliable elastic material.

In another embodiment of the invention, the hinge is provided by a weakened part in the neck portion. In this latter embodiment, the neck portion includes an outer sleeve slidable from a position over the hinge means to a position clear of the hinge means whereby when covering the hinge, the trigger sprayer is locked in the spraying position.

In another embodiment the trigger sprayer is mounted in a an upstanding position at one side of the container. To facilitate this mounting ledge may be provided projecting outwardly at a bottom of the side of the container.

In another embodiment the trigger sprayer is attached to the container by a mounting connector which includes a filling pipe for the container, said filling pipe being moveable between a sidewardly extending filling position for filling the container on its side and an upwardly extending in-use position for supporting the trigger sprayer alongside the side of the container when the container is upright.

In a further embodiment the filling pipe is cranked and the mounting connector is adapted to swivel on the container for movement of the filling pipe between the filling position and the in-use position.

In a further embodiment the filling pipe is connected to the container by a flexible bellows piece. This is sufficiently flexible to allow movement of the filling pipe between the filling and in-use position.

In another embodiment the container has a lower portion and an upper portion, the two portions defining a recess at the top of the container within which the trigger spray is mounted.

In another embodiment the trigger spray may be mounted on top of the lower portion upstanding beside the upper portion. Alternatively, the trigger spray may be mounted on a side of the upper portion projecting outwardly over the top of the lower portion.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF PREFERRED EMBODIMENTS

Figure 1:
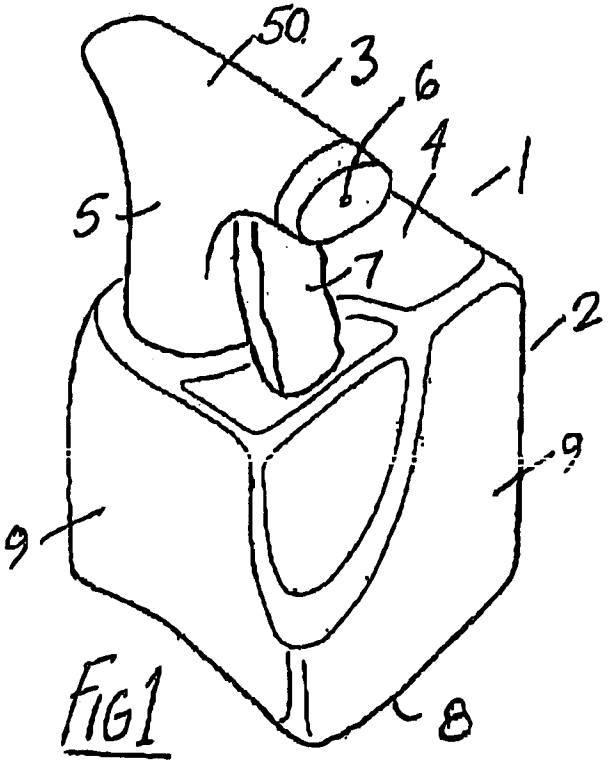
FIG. 1 is a perspective view of a trigger spray container assembly according to the invention.
Figure 2:
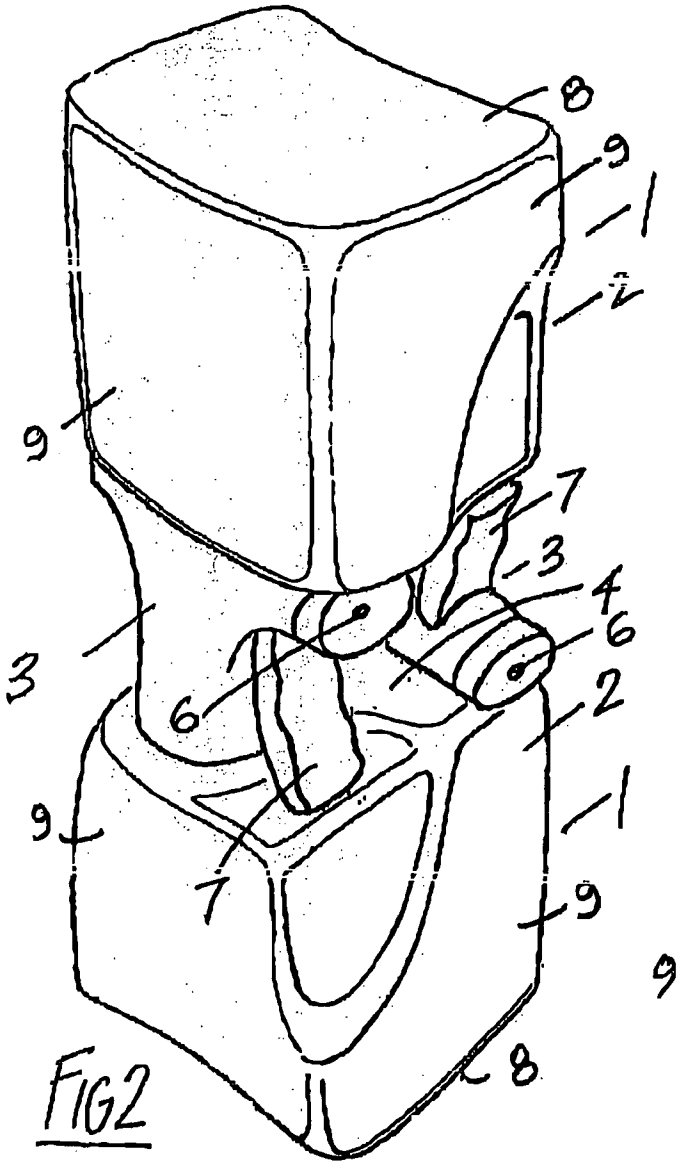
FIG. 2 is a perspective view of pair of the trigger spray container assemblies illustrated in FIG. 1 shown in a stacked position.

Referring to the drawings, and initially to FIGS. 1 and 2 thereof there is illustrated a trigger sprayer container assembly according to the invention indicated generally by the reference numeral 1. The assembly 1 has a generally cubic container 2 with a trigger sprayer 3 mounted thereon. It will be noted that the trigger sprayer 3 is mounted on a top 4 of the container 2 offset from a centre of the container 2 to allow stacking of mutually inverted pairs of container assemblies 1 as shown in FIG. 2. To achieve the stacking, the uppermost container assembly 1 is inverted and the trigger sprayers 3 are nested side by side as shown, each trigger sprayer 3 engaging the top of the other adjacent container 2.

The trigger sprayer 3 has a body 5 with a nozzle 6 which is connected to an outlet of a pump (not shown) housed within the body 5 and operated by a trigger 7. A liquid pick-up tube (not shown) leads from an inlet of the pump to a bottom of the container 2 for delivery of liquid from the container 2 through the pump for discharge through the nozzle 6 in response to manipulation of the trigger 7.

The container 2 has a generally cubic body with a substantially square top 4, bottom 8 and sides 9. This provides a container 2 of substantially uniform cross-sectional area between the top 4 and the bottom 8 of the container 2. The container 2 thus is very stable, even when only partially full of liquid. It is also very space efficient as the volume within the container substantially corresponds to the spatial volume occupied by the container 2.

It will be noted that the top 4 of the container 2 in combination with an uppermost surface 50 of the trigger sprayer 3 together form a support surface for reception and support of another container assembly 1 stacked thereon.

Figure 4:
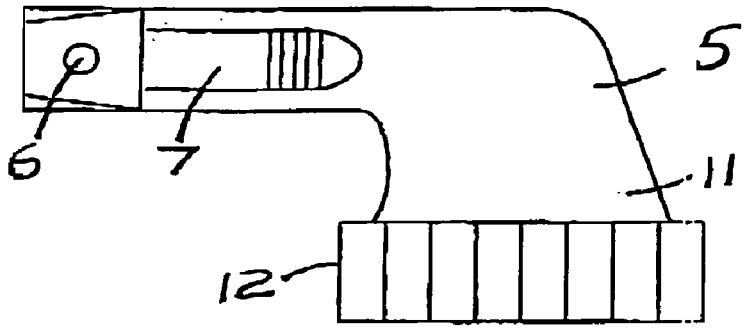
FIG. 4 is a side view of a trigger sprayer of the assembly shown in FIG. 3.
Figure 3:
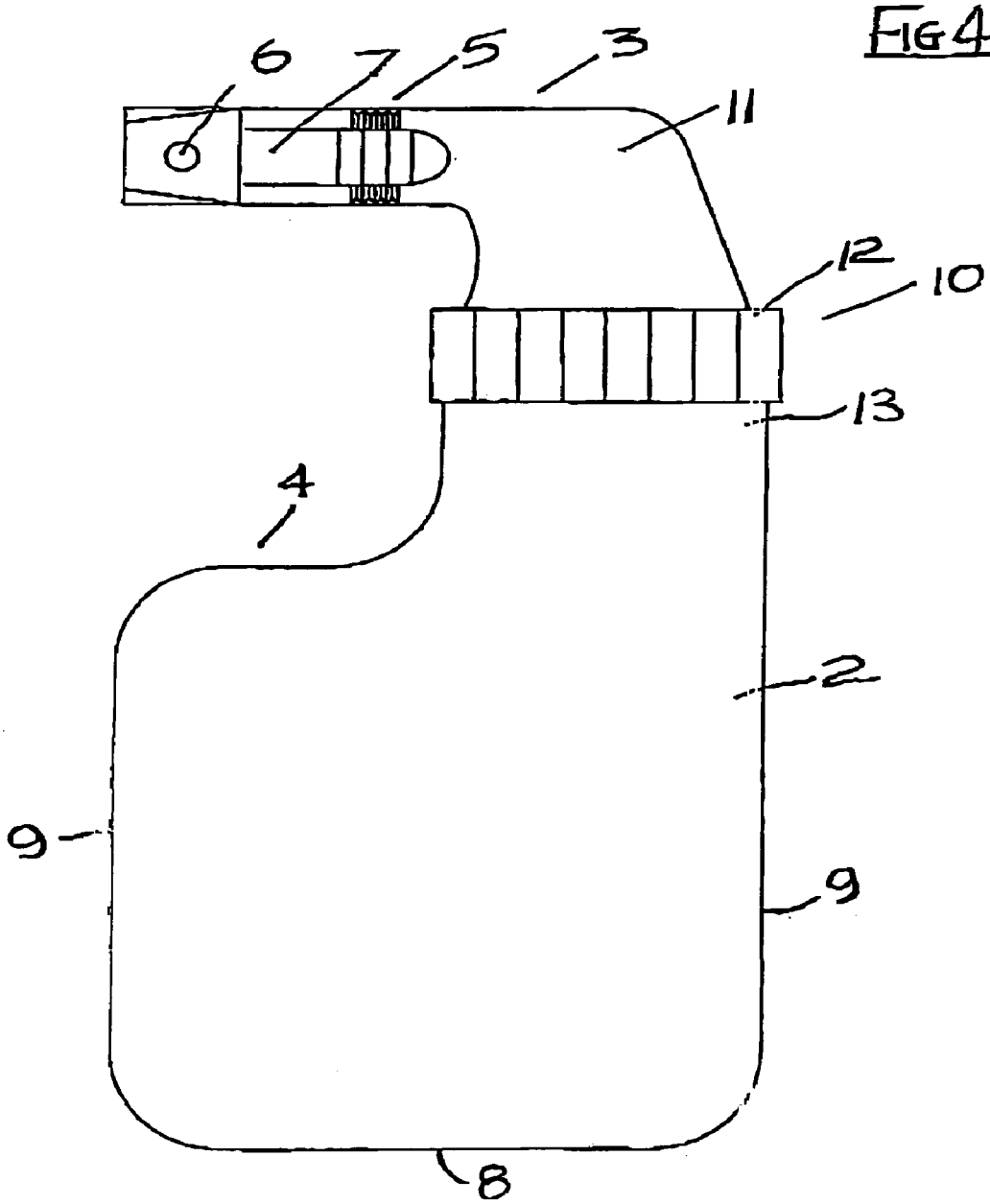
FIG. 3 is a side view of a trigger spray container assembly according to a second embodiment of the invention.
Figure 6:
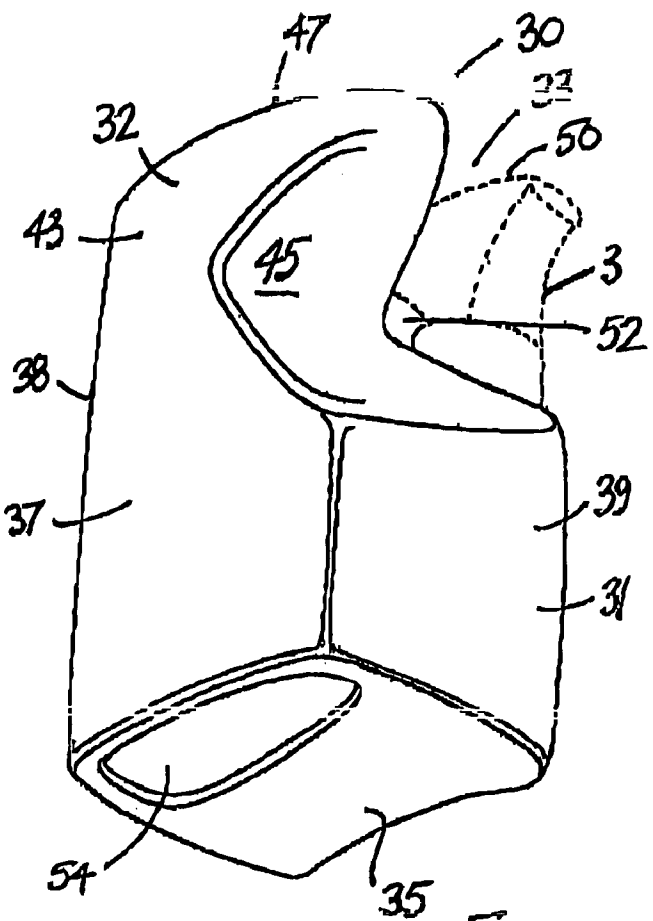
FIG. 6 is an underneath perspective view of the assembly shown in FIG. 5.
Figure 5:
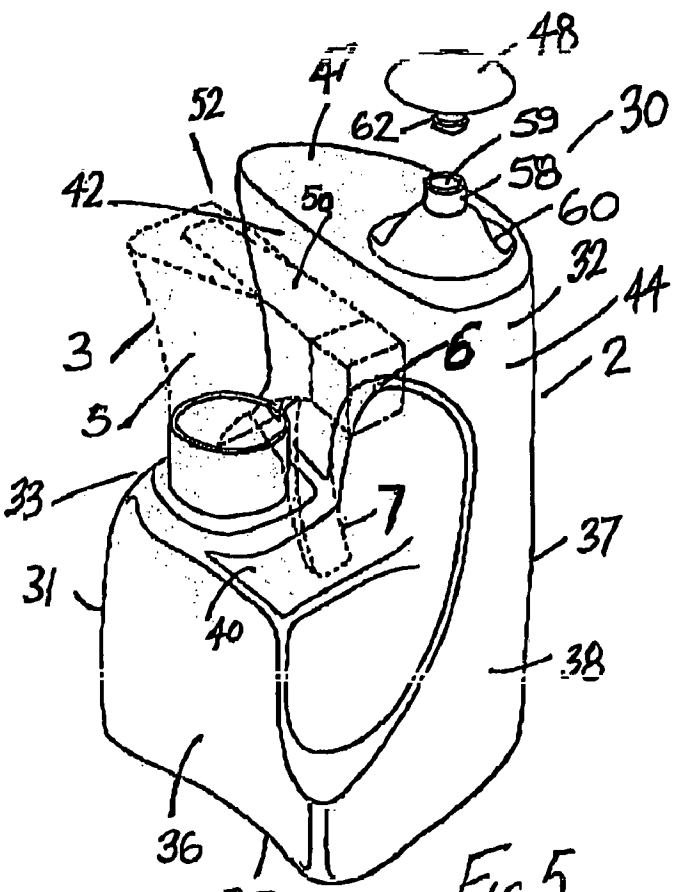
FIG. 5 is a perspective view of another trigger spray container assembly according to a third embodiment of the invention.

Referring now to FIGS. 3 and 4 there is illustrated another trigger spray container assembly indicated generally by the reference numeral 10. Parts similar to those described previously are assigned the same reference numerals. In this case the trigger sprayer 3 is mounted in a substantially horizontal orientation above the top 4 of the container 2. It will be noted that the body 5 of the trigger sprayer 3 has a cranked inner end 11 upon which a threaded collar 12 is mounted for engagement with a complementary threaded neck 13 which projects upwardly from the top 4 of the container 2 at one side of the top 4 of the container 2. It will be appreciated that this arrangement also provides a space efficient and stackable trigger spray container assembly.

Referring now to FIGS. 5 to 9 there is illustrated another trigger spray container assembly according to the invention indicated generally by the reference numeral 30. Parts similar to those described previously are assigned the same reference numerals. In this case a container 32 is provided which is generally L-shaped having a lower portion 31 and a stepped upper portion 32 which extends upwardly from one side of the lower portion 31 and defines therewith a recess 33 within which the trigger sprayer 3 is mounted.

The lower portion 31 of the container has a generally rectangular base 35 with an upstanding front wall 36, rear wall 37 and end walls, 38, 39. A top 40 of the lower portion 31 extends inwardly from the front wall 36 to the upper portion 32.

The upper portion 32 has a front wall 42 which extends upwardly at an inner end of the top wall 40 of the lower portion 31, a rear wall 43 which forms an extension of the rear wall 37 of the lower portion 31 and end walls 44, 45 integrally formed with and forming an extension of the end walls 38, 39 of the lower portion 31. A top 47 of the upper portion 32 is generally flat and may be provided with a filling opening covered by a sealing cap 48.

It will be noted that the trigger sprayer 3 has a generally flat and substantially horizontal top surface 50 which is substantially flush with the top 47 of the upper portion 32. Thus, between them, the top 47 of the upper portion 32 and the top 50 of the trigger sprayer 3 form a support surface to allow stacking of the trigger spray container assemblies 30.

It will be noted that in this case the trigger sprayer 3 is closely mounted to the front face 42 of the upper portion 32 so that in use, a user grips both the trigger sprayer 3 and the upper portion 32, the users fingers gripping the trigger sprayer 3 with the thumb extending around the upper portion 32, a rear end of which is shaped as shown at 52 for reception of the thumb.

Figure 9:
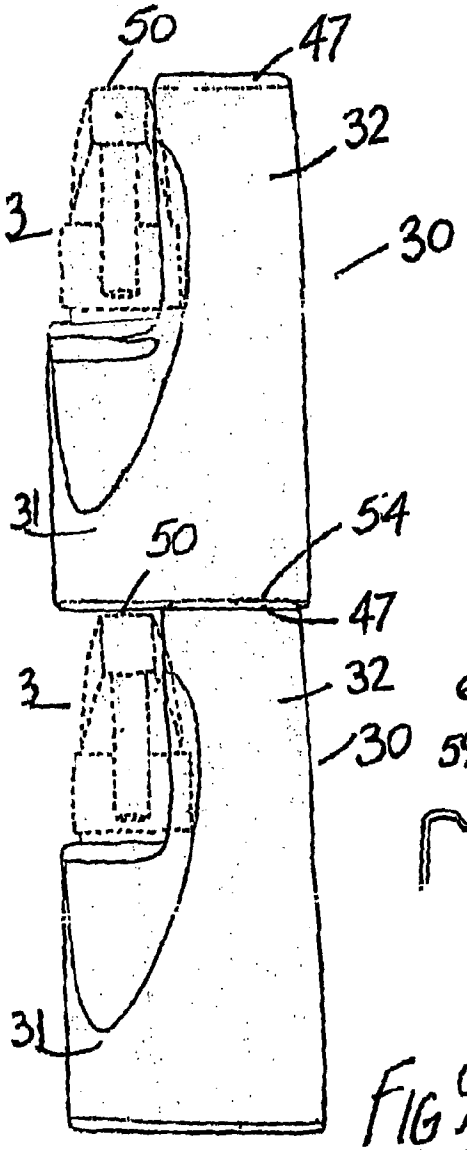
FIG. 9 is an elevational view showing tow of the container assemblies of FIG. 5 stacked one above the other.

It will be noted that the container has an indented recess 54 in the base 35 for complementary engagement with the top 47 of the upper portion 32 which nests within the recess 54 when tow of the container assemblies 30 are stacked as shown in FIG. 9.

Figure 8:
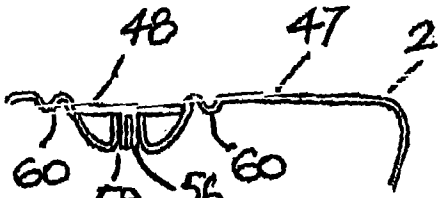
FIG. 8 is a view similar to FIG. 7 showing the portion in another position of use.
Figure 7:
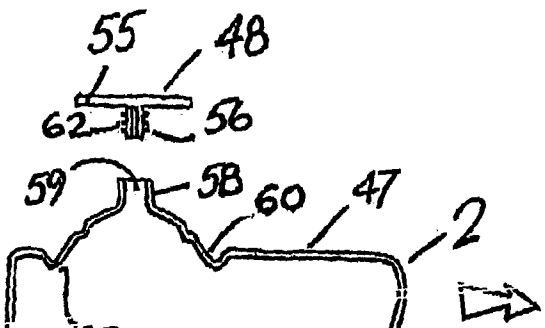
FIG. 7 is a detail, partially exploded sectional elevational view of portion of the assembly of FIG. 5.

Also, one possible arrangement for the sealing cap 48 is shown particularly in FIGS. 7 and 8. The sealing cap 48 has a flange 55 with a central plug 56 extending downwardly therefrom for engagement within a complementary neck 58 defining a filling opening 59 in the top 47 of the container by means of a flexible annular neck ring 60. This allows the neck 58 to be pulled outwardly as shown in FIG. 7 for filling. Then, when the sealing cap 48 is engaged in the opening 59, with resilient fins 62 and the plug 56 sealingly engaging a bore of the opening 59, upon depressing the cap 48 the neck assembly can be pushed into the container as shown in FIG. 8, such that it does not project above the top 47 of the container. Thus, conveniently it will not interfere with stacking the containers.

Figure 10:
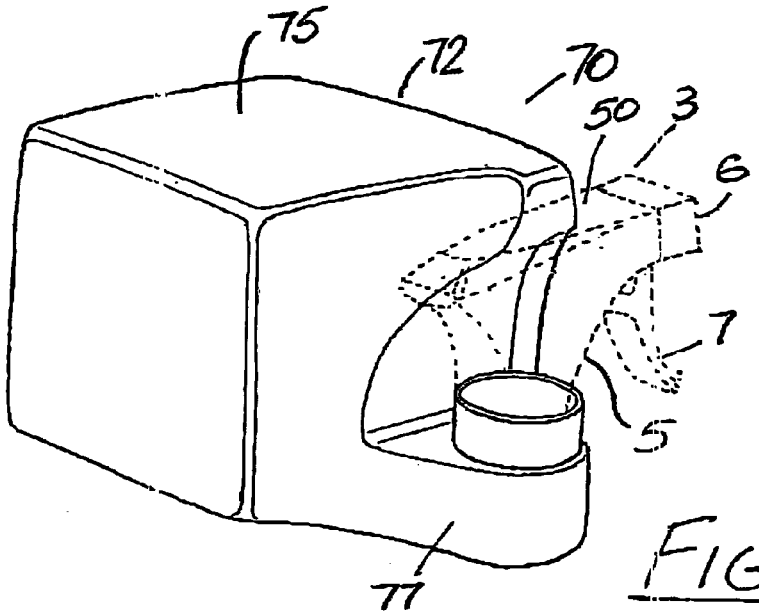
FIG. 10 is a perspective view of another trigger spray container assembly.
Figure 11:
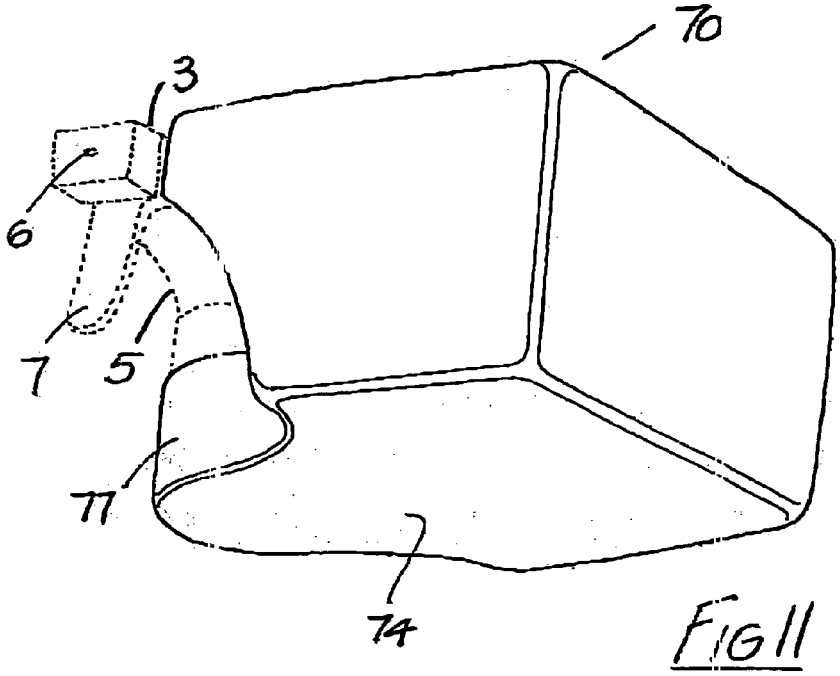
FIG. 11 is an underneath perspective view of the assembly shown in FIG. 10.
Figure 12:
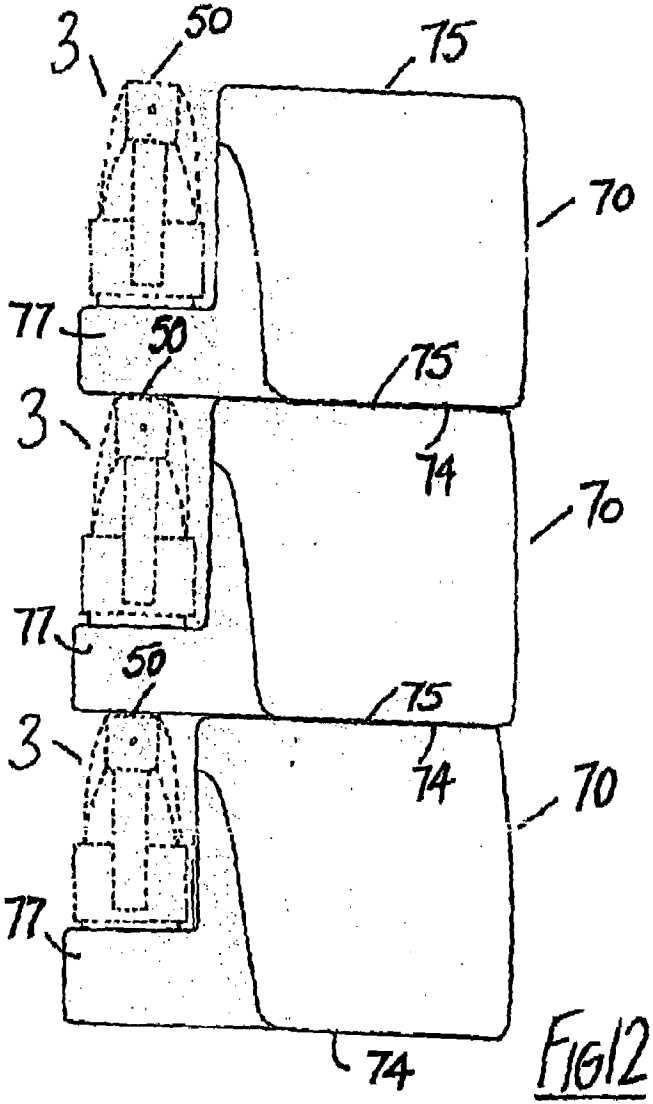
FIG. 12 is an elevational view showing three of the container assemblies of FIG. 10 shown stacked together one above the other.

Referring now to FIGS. 10 to 12 there is shown another trigger spray container assembly according to the invention, indicated generally by the reference numeral 70. Parts similar to those described previously are assigned the same reference numerals. In this case, the container assembly 70 has a container 72 of essentially cubic shape with a flat base 74 and a flat top 75 of relatively large surface area to provide for good stability and stackability. A trigger sprayer support portion 77 projects outwardly at one side of the container 72 and the trigger sprayer 3 is mounted thereon with the top 50 substantially flush with the top 75 of the container 72 as previously described. FIG. 12 shows three of the container assemblies 70 stacked one above the other, the relatively large surface area of the base 74 and top 75 providing excellent stability.

Figure 15:
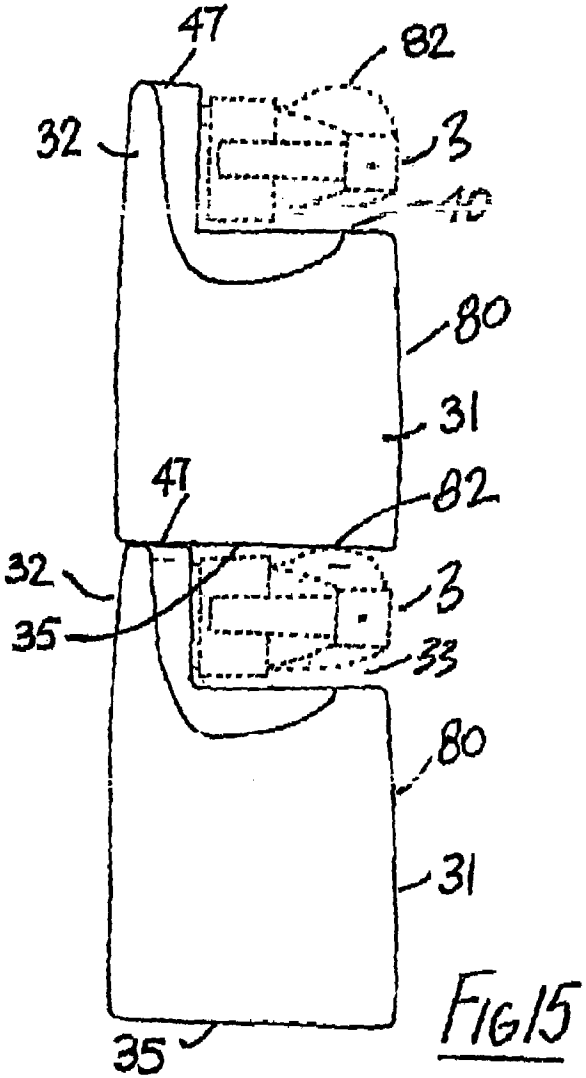
FIG. 15 is an elevational view showing tow of the assemblies of FIG. 13 stacked one above the other.
Figure 14:
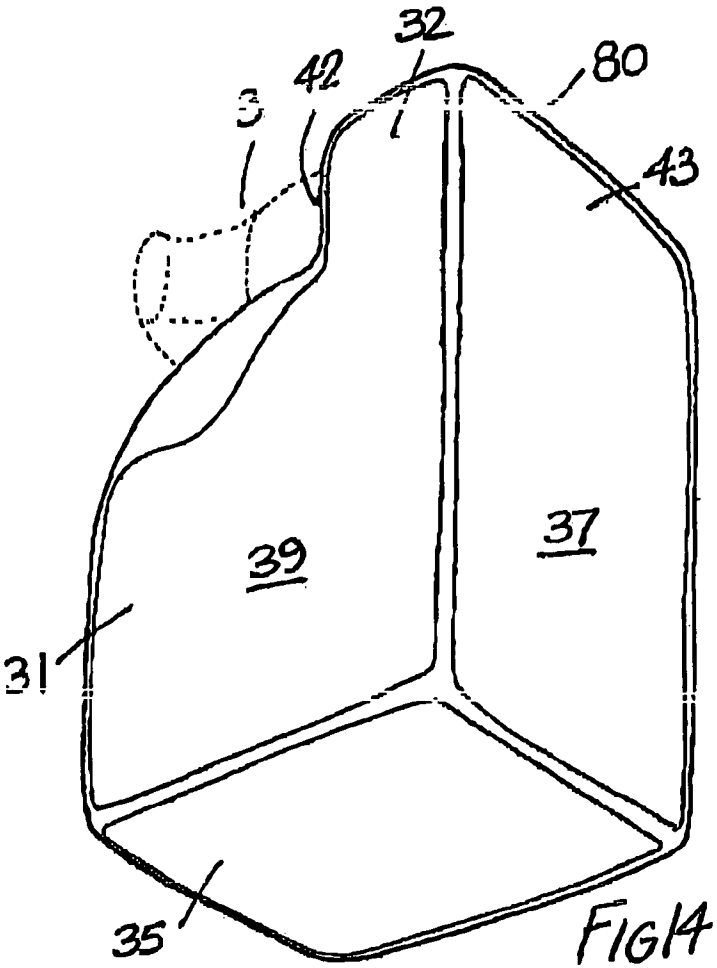
FIG. 14 is an underneath perspective view of the assembly as shown in FIG. 13.
Figure 13:
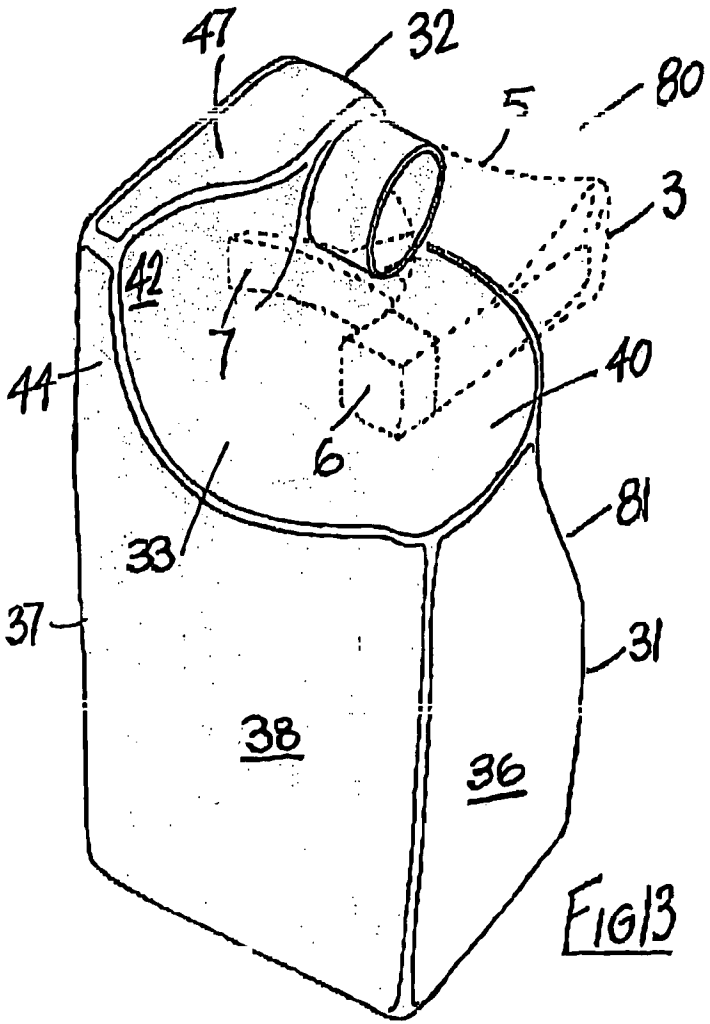
FIG. 13 is a perspective view of another trigger spray container assembly.

Referring now to FIGS. 13 to 15 there is illustrated another trigger spray container assembly indicated generally by the reference numeral 80. Parts similar to those described previously as assigned the same reference numerals. This has a container 81 whose construction is largely similar to that of the container shown in FIG. 5 however in this case the upper portion 32 is somewhat smaller as the trigger sprayer 3 is mounted in a horizontal orientation (as shown in broken outline) from the front face 42 of the upper portion 32. Thus the trigger sprayer 3 projects out over the top 40 of the lower portion 31, again the trigger sprayer 3 being located within the recess 33. FIG. 15 shows the stacking of two of the dispensers 80. It will be noted that an uppermost side edge 82 of the trigger sprayer 3 forms a stacking support with the top 47 of the upper portion 32 for stacking the container assemblies 80.

Figure 18:
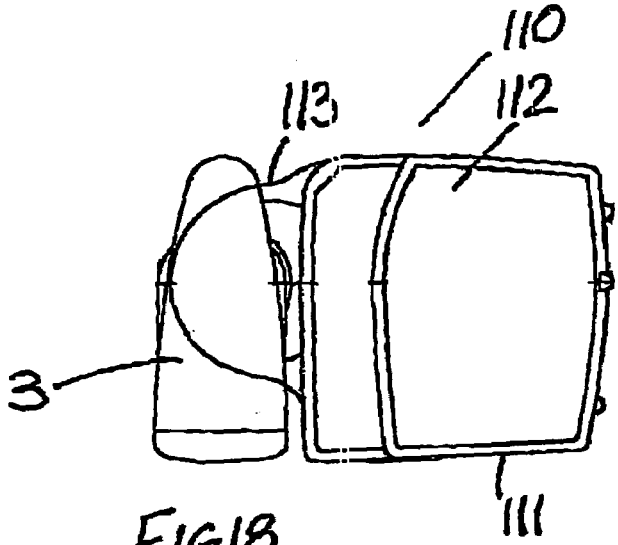
FIG. 18 is a plan view of the trigger spray container assembly of FIG. 16.
Figure 17:
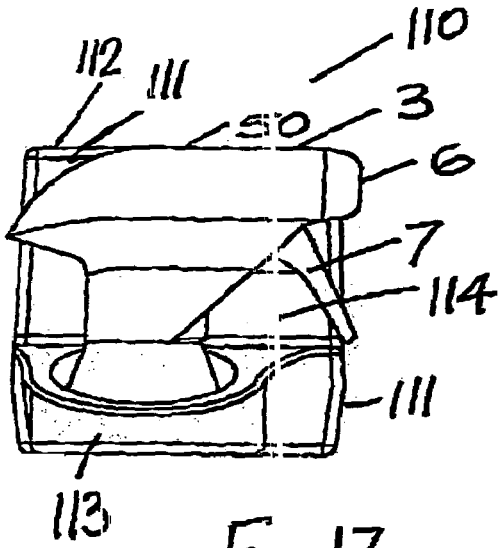
FIG. 17 is an end elevational view of the trigger spray container assembly of FIG. 16.
Figure 16:
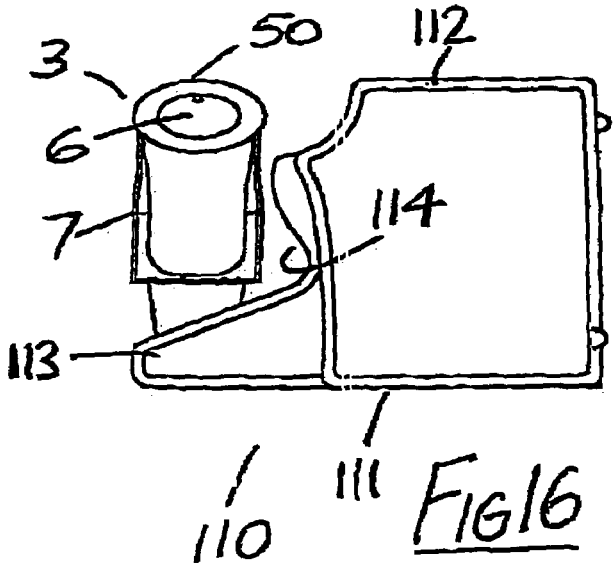
FIG. 16 is an elevational view of a further trigger spray container assembly.
Figure 20:
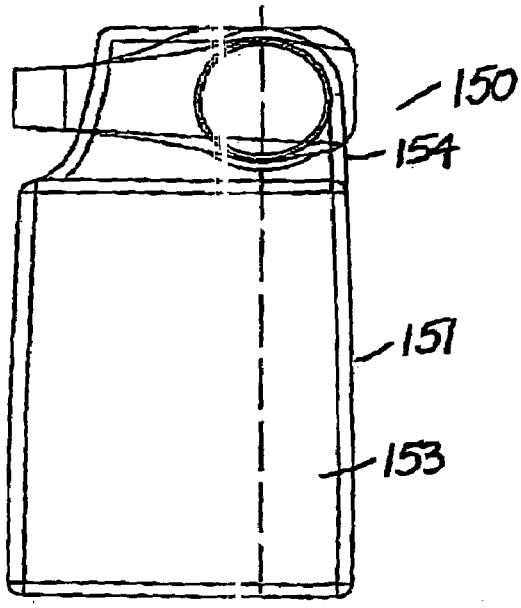
FIG. 20 is an end elevational view of the trigger spray container assembly of FIG. 19.
Figure 22:
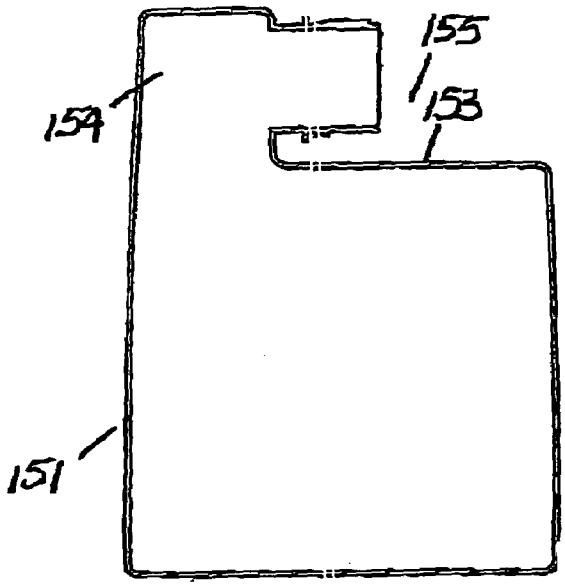
FIG. 22 is a sectional elevational view of a container portion of the trigger spray container assembly of FIG. 19.
Figure 19:
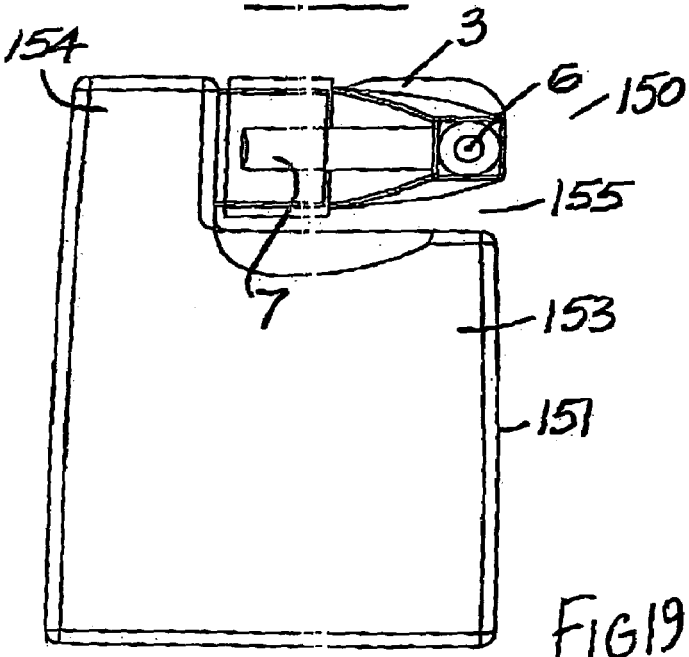
FIG. 19 is an elevational view of another trigger spray container assembly.
Figure 21:
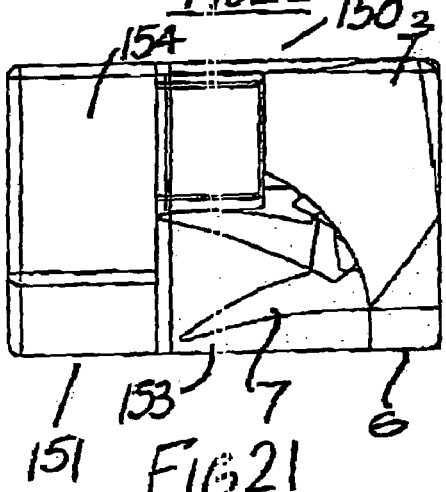
FIG. 21 is a plan view of the trigger spray container assembly of FIG. 19.
Figure 24:
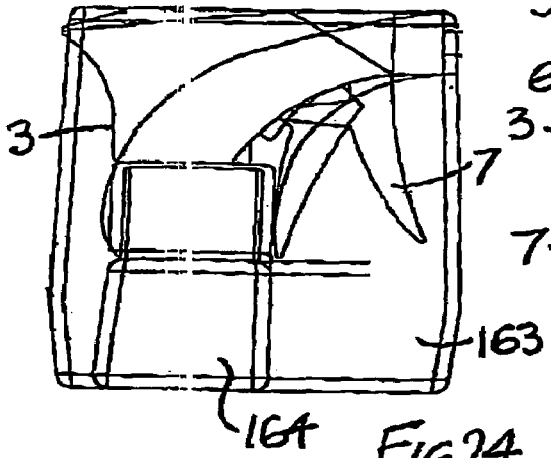
FIG. 24 is an end elevational view of the trigger spray container assembly of FIG. 23.
Figure 23:
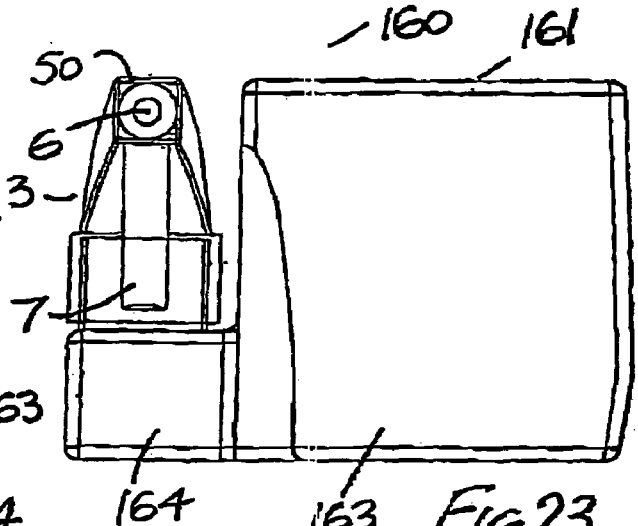
FIG. 23 is an elevational view of another trigger spray container assembly.
Figure 25:
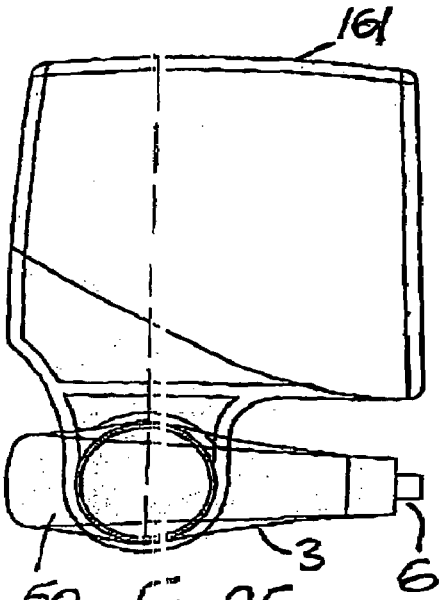
FIG. 25 is a plan view of the trigger spray container assembly of FIG. 23.
Figure 26:
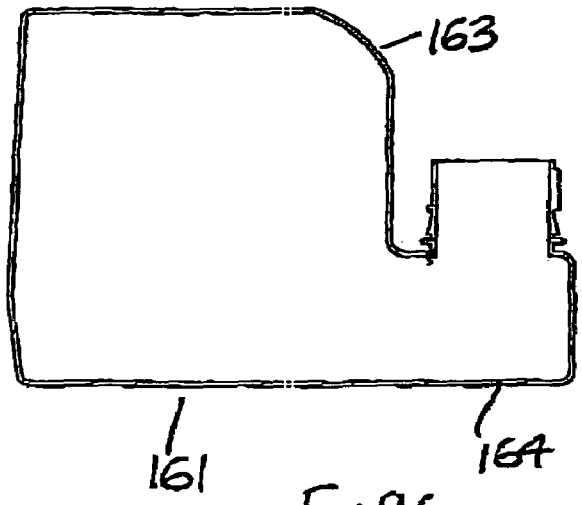
FIG. 26 is a sectional view of a container of the trigger spray container assembly of FIG. 23, FIGS. 27-30 show elevational views of various different containers for trigger spray container assemblies of the invention.
Figure 27:
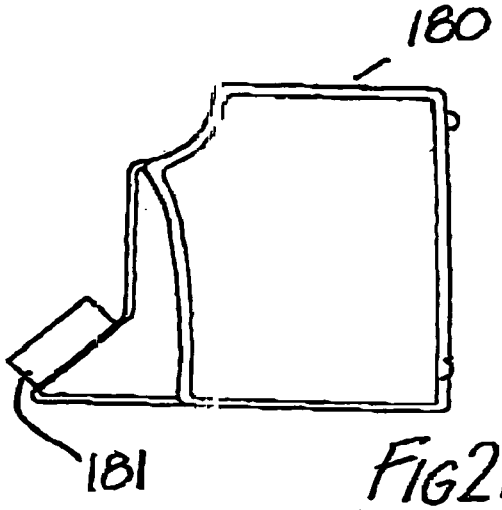
Figure 28:
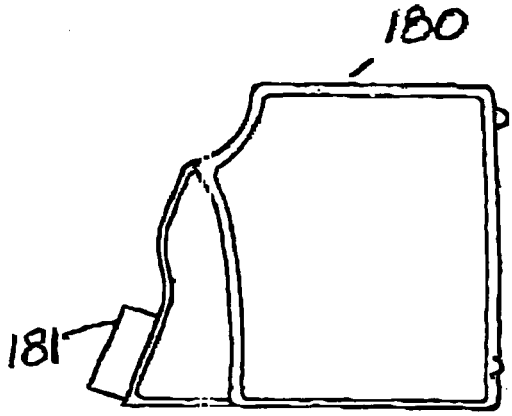
Figure 29:
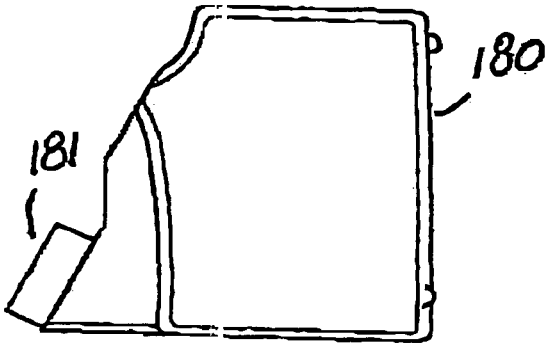
Figure 30:
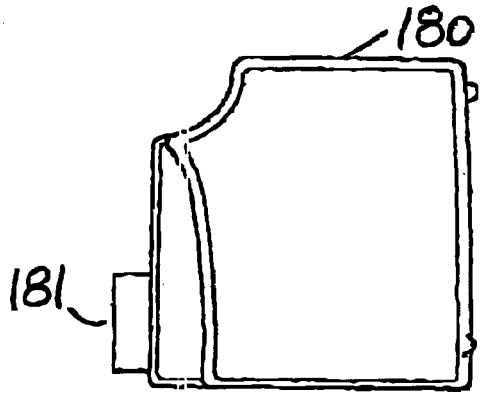
Figure 31:
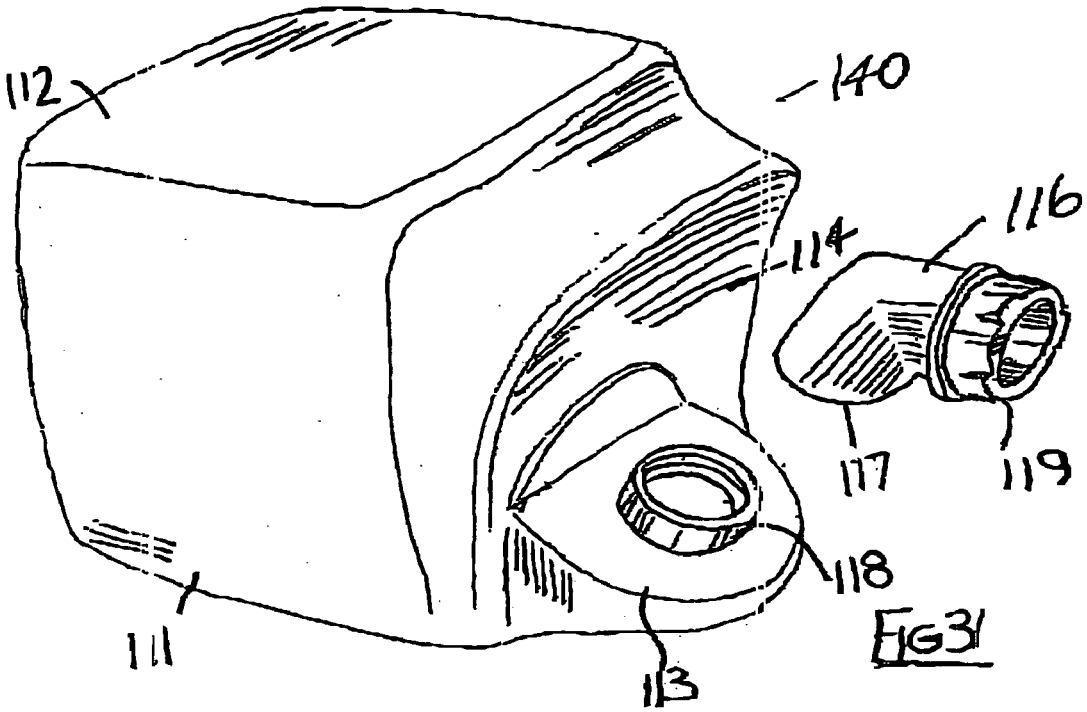
FIG. 31 is a perspective view of a container for another trigger spray container assembly.

Referring now to FIGS. 16 to 18 there is shown another trigger spray container assembly indicated generally by the reference numeral 110. The assembly 110 includes a container 111 having a generally cubic shape. A trigger sprayer 3 is mounted in an upstanding position at one side of the container 111. To facilitate this a mounting ledge 113 is provided projecting outwardly at the bottom of one side 114 of the container 111. It will be noted that the top 50 of the trigger sprayer 3 is flush with a top 112 of the container 111. It will be also noted that the side wall 114 is curbed to facilitate insertion of a persons thumb when gripping the tripper sprayer 3 to hold the trigger spray container assembly 110 in use.

Referring now to FIGS. 19 to 22 there is shown another trigger spray container assembly indicated generally by the reference numeral 150. The assembly 150 has a box-shaped container 151 with a trigger sprayer 3 mounted thereon. The container 151 has a lower portion 153 of generally rectangular parallelepiped shape and an upper portion 154 which projects upwardly from a top of the lower portion 153 at one side of the lower portion 153 defining therewith a recess 155 at the top of the container 151 within which the trigger sprayer 3 is housed. In this case the trigger sprayer 3 is mounted on a side of the upper portion 154 projecting outwardly over the top of the lower portion 153. It will be noted that the arrangement facilitates a stacking of trigger spray container assemblies 150 and the container shape and construction is generally space efficient and very stable.

Referring now to FIGS. 23 to 26 there is shown another trigger spray container assembly indicated generally by the reference number 160. The assembly 160 comprises a container 161 on which a trigger sprayer 3 is mounted. In this case the container 161 has a main body 163 of generally cubic shape with a mounting step 164 projecting outwardly on one side of the container 161 for supporting the trigger sprayer 3 alongside the container 161 with a top of the trigger sprayer 3 being flush with a top of the container 161.

Referring now to FIGS. 27 to 30, these show a container 180 for a trigger spray container assembly having a mounting collar 181 for mounting a trigger sprayer at one side of the container 180, the mounting collar 181 being shown in a number of configurations on the container 180.

Figure 32:
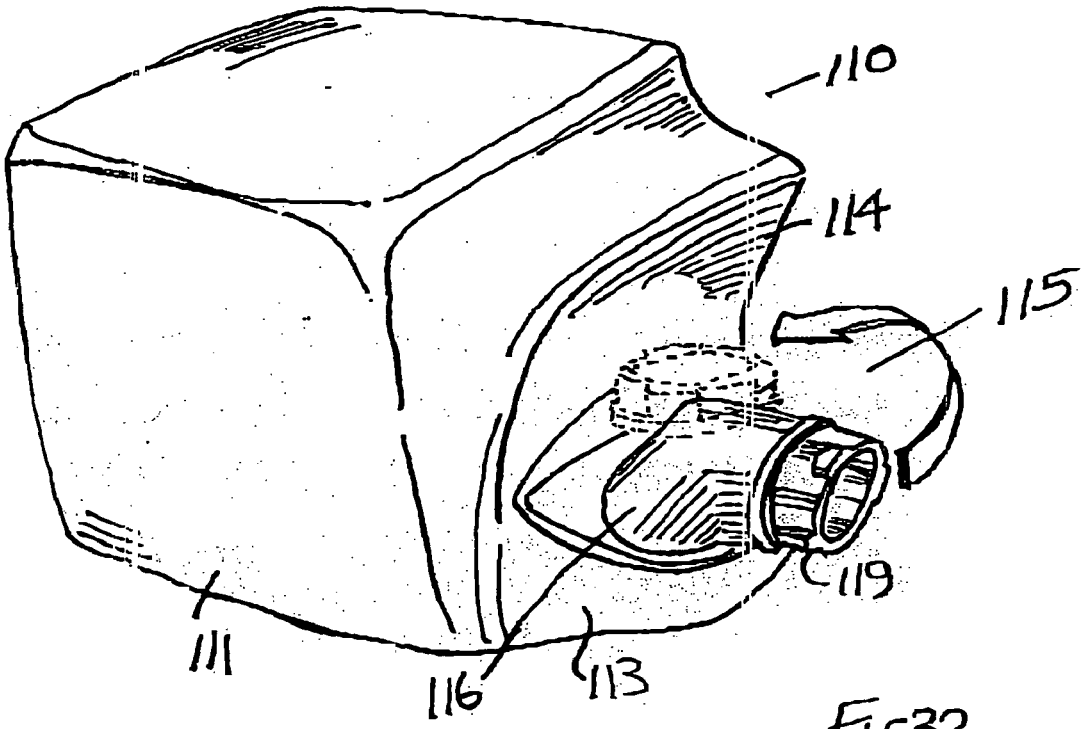
FIG. 32 is another perspective view of the container of FIG. 31.
Figure 36:
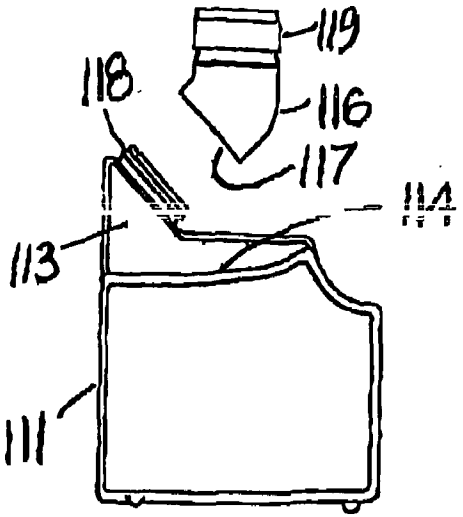
Figure 33:
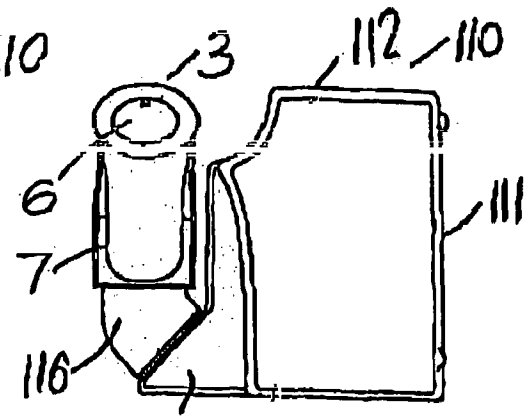
FIG. 33 is an elevational view of a trigger spray container assembly incorporating the container of FIG. 31.
Figure 34:
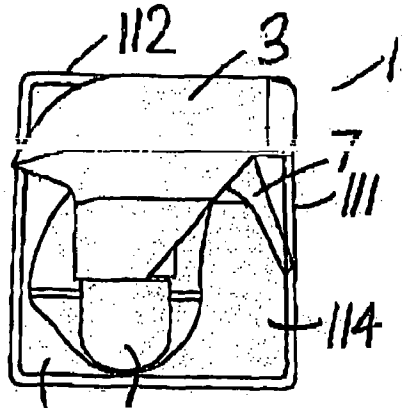
FIG. 34 is an end elevational view of the trigger spray container assembly of FIG. 33.
Figure 35:
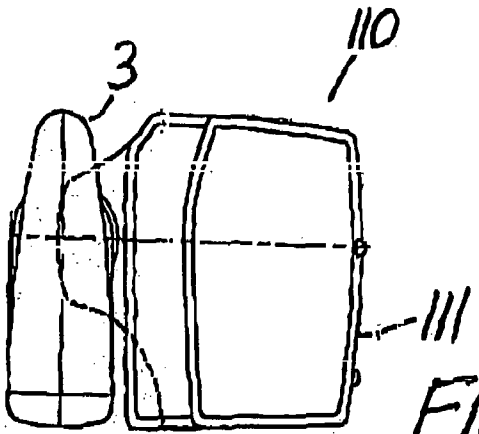
FIG. 35 is a plan view of the container assembly of FIG. 33, FIG. 36-39 are elevational views showing sequential steps in the construction, filling and assembly of the trigger spray container assembly of FIG. 33.
Figure 37:
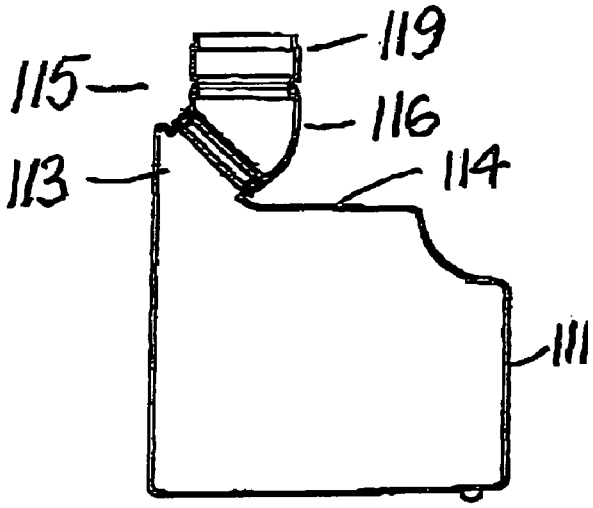
Figure 38:
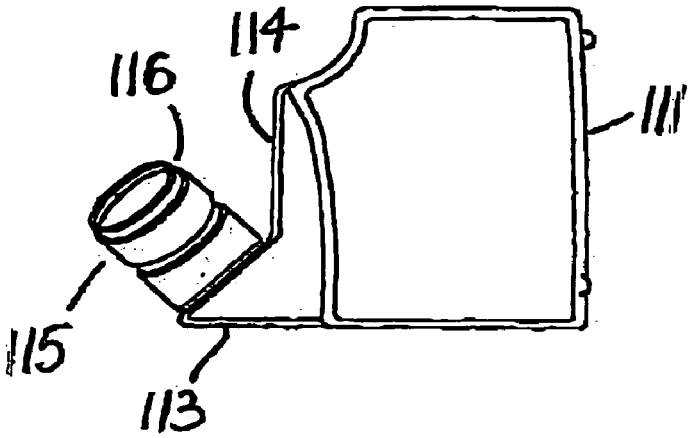
Figure 39:
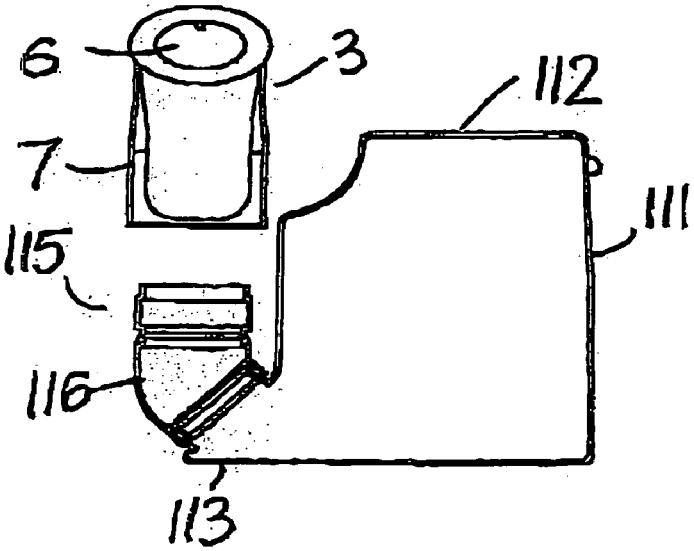

Referring now to FIGS. 31 to 39 there is shown another trigger spray container assembly indicated generally by the reference numeral 140. This is largely similar to the trigger spray container assembly described previously with reference to FIGS. 16-18 and like parts are assigned the same reference numerals. The trigger sprayer 3 is attached to the container 111 by a mounting connector 115 which includes a cranked filling pipe 116 having an inner end 117 which swivels in a support 118 on the ledge 113 and an outer end 119 adapted for connection to the trigger sprayer 3. AS can be seen in FIG. 32 the filling pipe 116 can be swiveled on the support 118 between a sidewardly extending filling position for filling the container 111 on its side (FIG. 37) through an intermediate position (FIG. 38) to an upwardly extending in-use position (FIG. 39) for supporting the trigger sprayer 3 alongside the side 114 of the container 111. Thus, to facilitate filling of the container 111, the container is placed on its side as shown in FIG. 37 with the filling pipe 116 in an upwardly open position. After filling the trigger sprayer 3 is attached to the outer end 119 of the filling pipe 116 which can be swiveled as shown in FIGS. 38 and 39 to the in-use position supporting the trigger sprayer 3 alongside the container 111.

Figure 40:
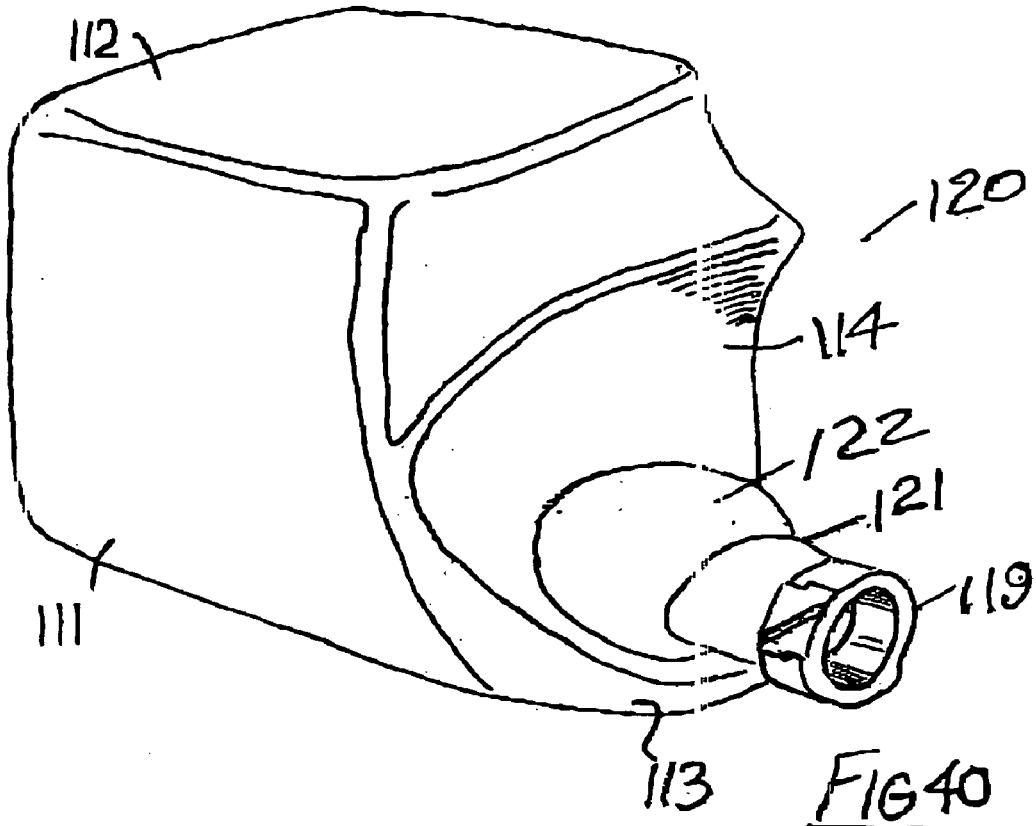
FIG. 40 is a perspective view of a container for another trigger spray container assembly.
Figure 41:
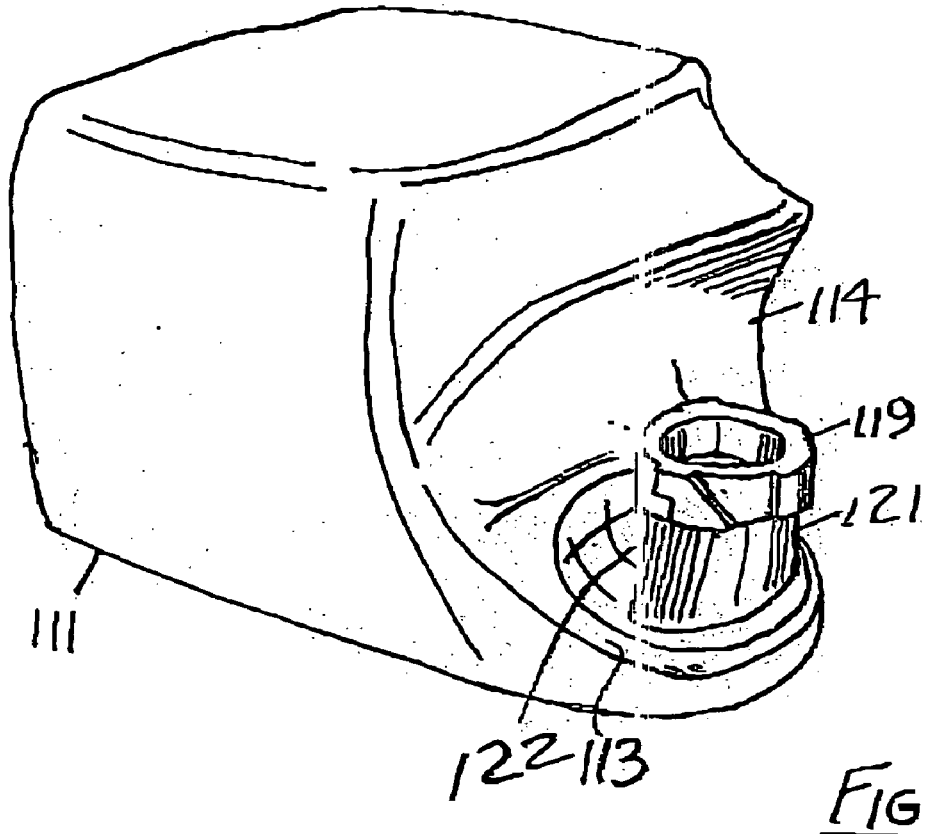
FIG. 41 is a perspective view of the container of FIG. 40.
Figure 42:
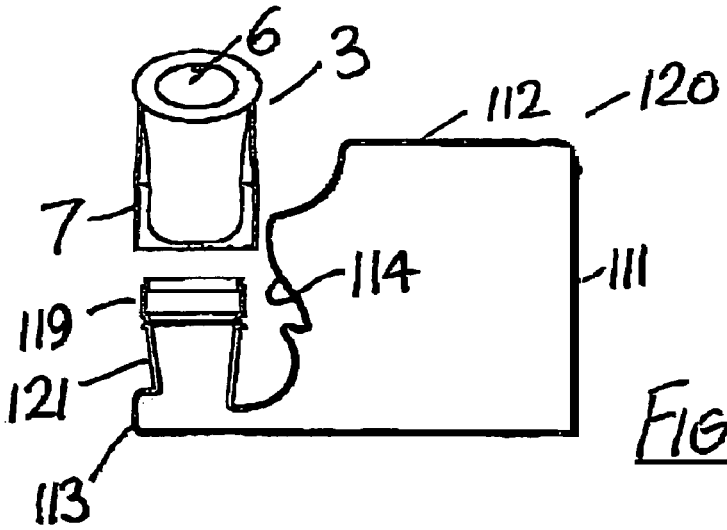
FIG. 42 is an exploded elevational view of a trigger spray container assembly incorporating the container of FIG. 40.
Figure 43:
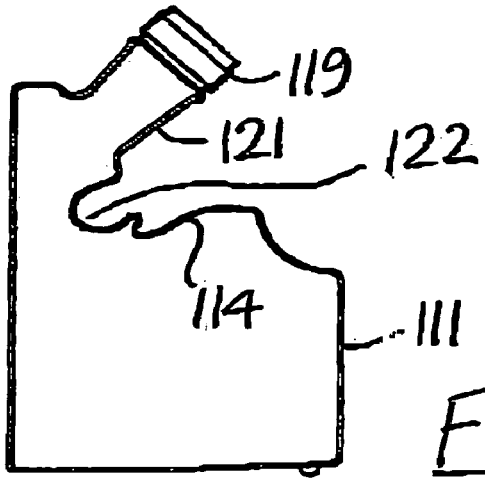
FIG. 43 is a sectional elevational view of the container of FIG. 40 shown in one position of use.
Figure 44:
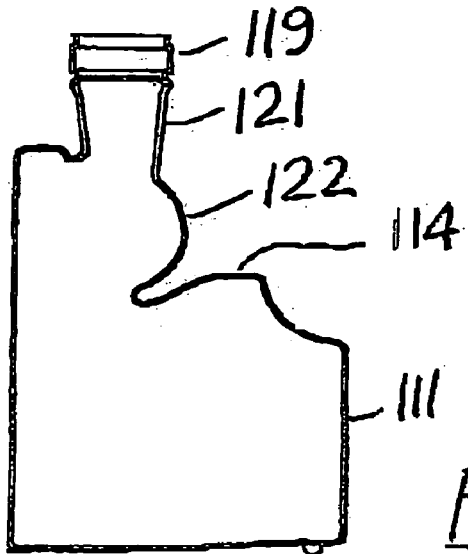
FIG. 44 is a view similar to FIG. 43 showing the container in another position of use.
Figure 45:
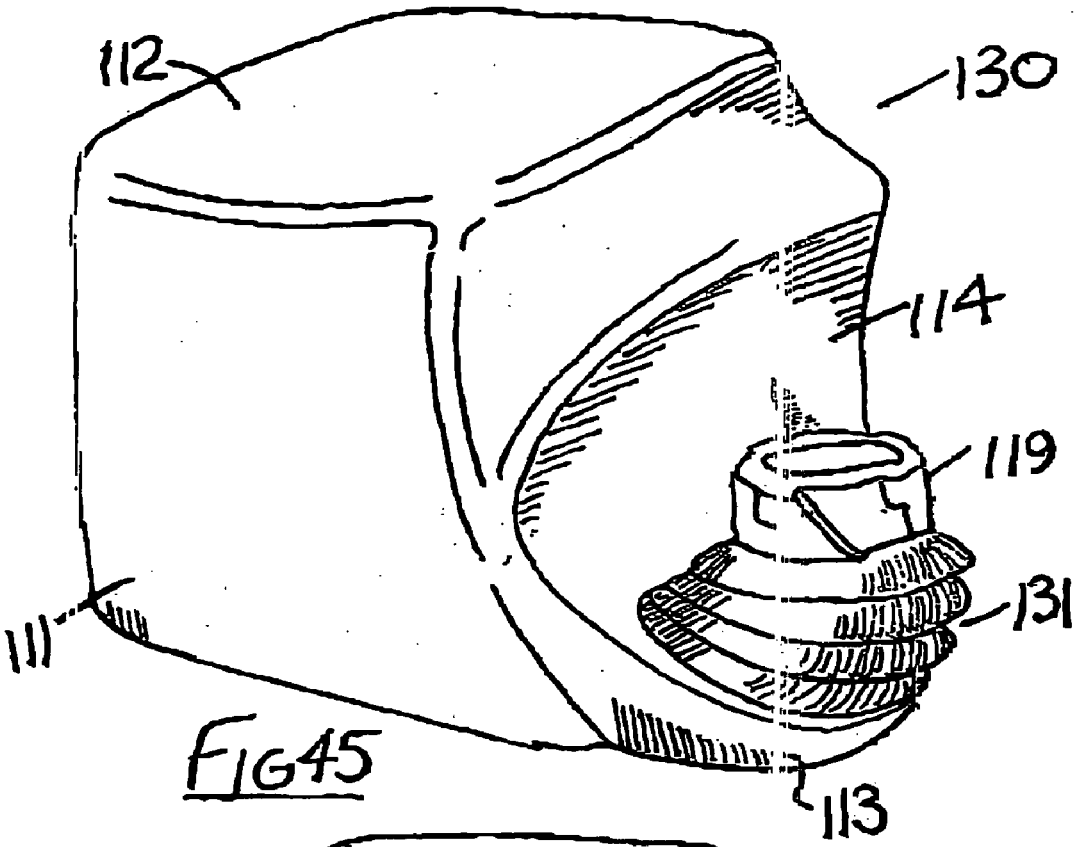
FIG. 45 is a perspective view of a container of another trigger spray container assembly.
Figure 46:
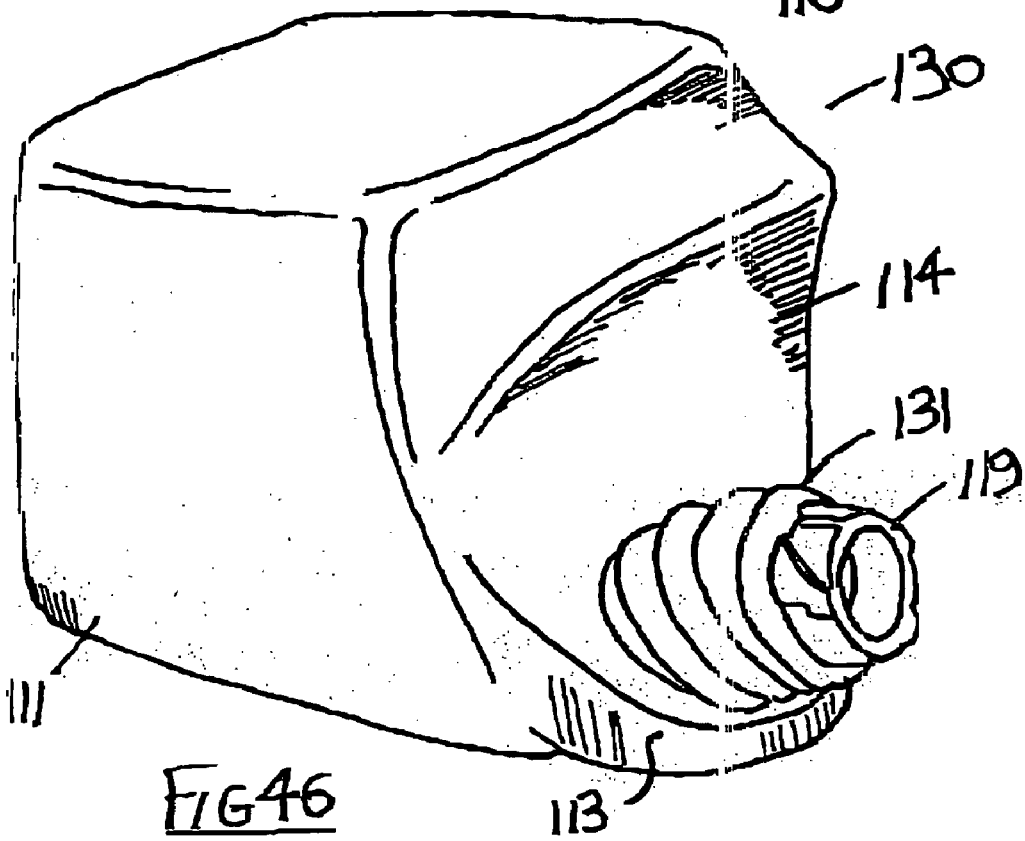
FIG. 46 is another perspective view of the container of FIG. 45.
Figure 47:
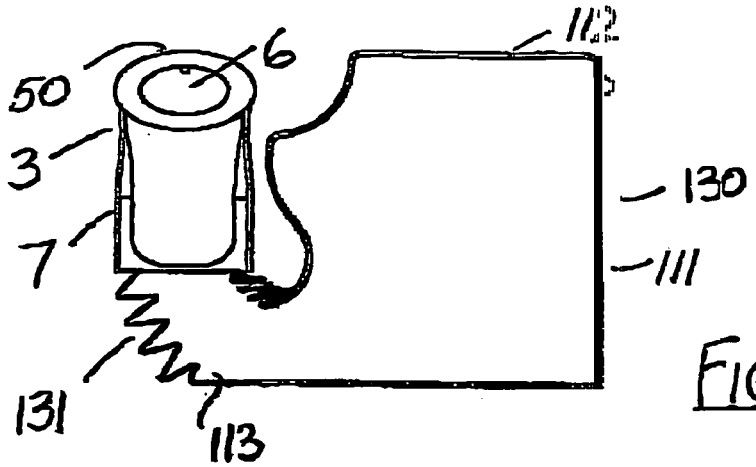
FIG. 47 is a sectional elevational view of a trigger spray container assembly incorporating the container of FIG. 45.

Referring now to FIGS. 40 and 44, there is shown another trigger spray container assembly indicated generally by the reference numeral 120. Parts similar to those described previously are assigned the same reference numerals. In this case a filling pipe 121 is connected to the container 111 by a domed connector piece 122 of plastics material which is sufficiently flexible to allow inversion of the domed piece as shown in FIG. 1 for movement of the filling pipe 121 between the sidewardly extending filling position of FIG. 40 and the upwardly extending in-use position for supporting a trigger sprayer 3 alongside the side of the container as shown in FIGS. 41 and 42. After filling the container on its side, as shown in FIG. 44, the trigger sprayer 3 is attached to the filling pipe 121 and the dome 122 is then pushed and snapped inwardly into the container as shown in FIG. 43 in which the filling pipe 121 is in an intermediate position and the fully inverted dome position, shown in FIGS. 41 and 42, supports the filling pipe 121 and trigger sprayer 3 in an upright position alongside the container 111.

Figure 48:
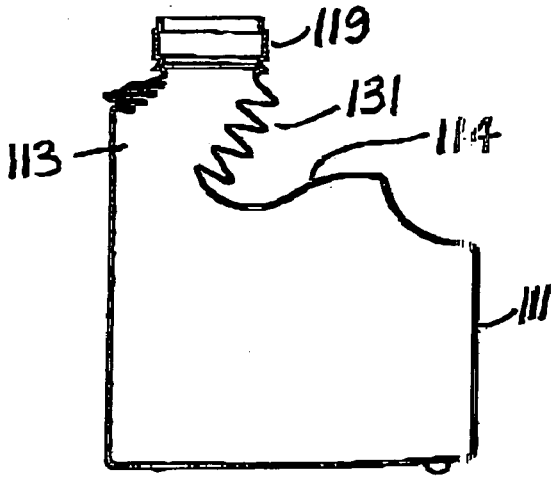
FIG. 48 is a sectional view of the container of FIG. 46 shown in one position of use.
Figure 49:
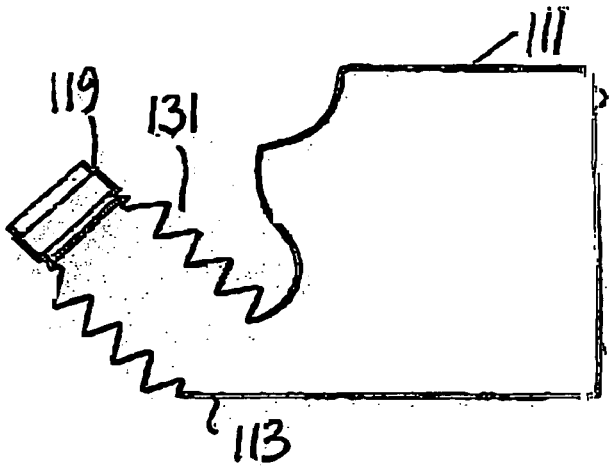
FIG. 49 is a sectional elevational view of the container of FIG. 45 shown in another position of use.

Referring to now to FIGS. 45 to 49, there is shown another trigger spray container assembly indicated generally by the reference numeral 130. Parts similar to those described previously are assigned the same reference numerals. In this case a filling pipe 131 is provided in the form of a bellows to allow swiveling of the filling pipe 131 between the sidewardly extending filling position (FIGS. 46 and 48) and the upwardly extending in-use position (FIGS. 45 and 47) for supporting the trigger sprayer 3 alongside the side of the container 111. Again, as shown in FIG. 48, the container 111 can be mounted on its side with the filling pipe 131 upwardly open for convenience of filling. Thereafter the trigger sprayer 3 can be attached and the filling pipe swiveled into the in-use position shown in FIGS. 45 and 47.

Figure 50:
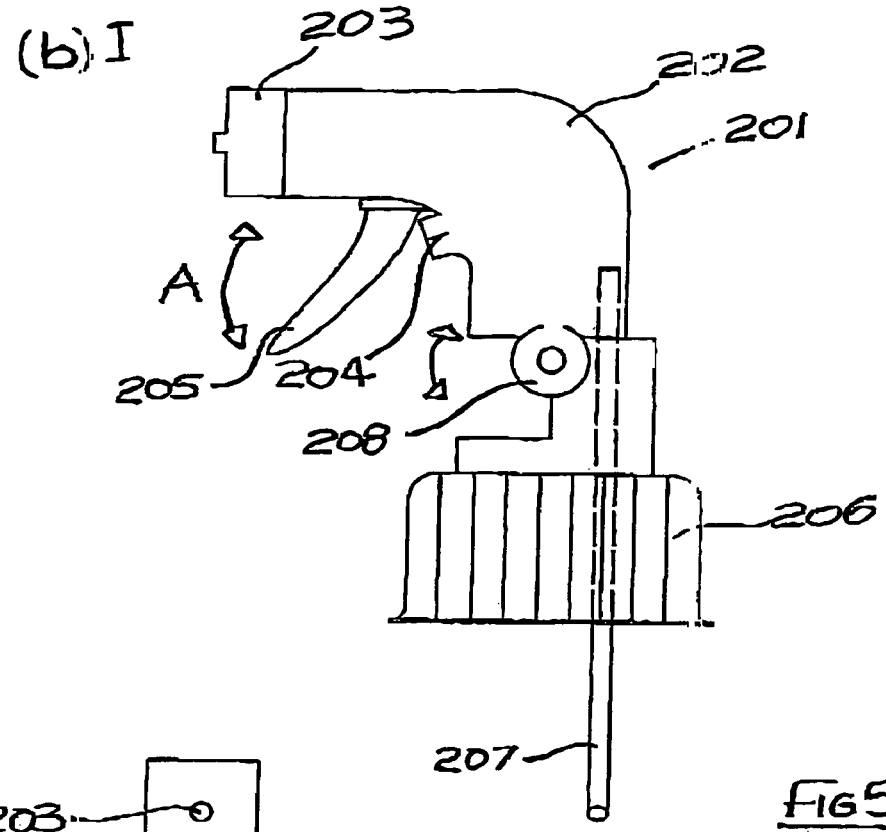
FIG. 50 is a side view of a trigger sprayer according to the invention.

Referring to FIG. 50, there is provided a trigger sprayer, indicated generally by the reference numeral 201 for mounting externally of an aperture in a liquid container not shown. Generally, such a liquid container will have a threaded neck portion. The trigger sprayer 201 comprises a spray head body 202 mounting a spray nozzle 203 and a liquid pump 204 operated by a reciprocating trigger 205. Means for mounting the spray head body 202 on the threaded neck of a container (not shown) is provided by a cap 206. Further, the spray head body 202 carries a container tube 207 connecting the pump 204 to the lowermost portion, in use, of the container. The spray head body 202 has a hinge 208 about which it can be folded in the direction of the arrow A.

Figure 51:
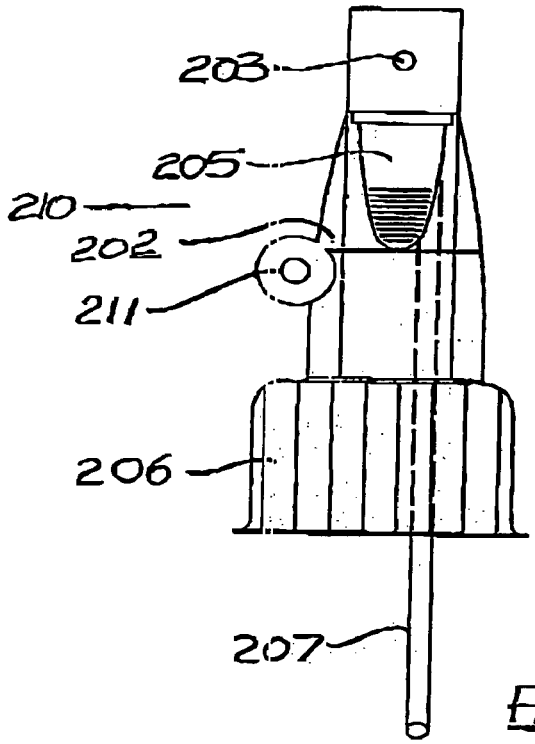
FIG. 51 is an end view of another trigger sprayer.

Referring to FIG. 51, there is shown an alternative construction of trigger sprayer, indicated generally by the reference numeral 210, in which parts similar to those described with reference to the previous drawing, are identified by the same reference numerals. In this embodiment, there is a hinge 211 mounted laterally of the spray head body 202.

Figure 52:
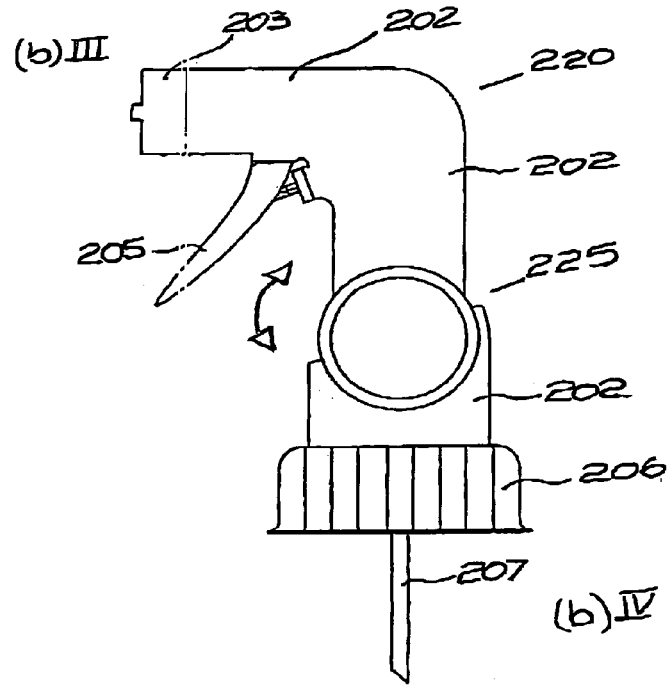
FIG. 52 is a side view of a still further trigger sprayer.

Referring now to FIG. 52, there is illustrated a further construction of trigger sprayer, indicated generally by the reference numeral 220, and again parts similar to those described with reference to the previous drawings, are identified by the same reference numerals. In this embodiment, there is provided a hinge, indicated generally by the reference numeral 225.

Figure 54:
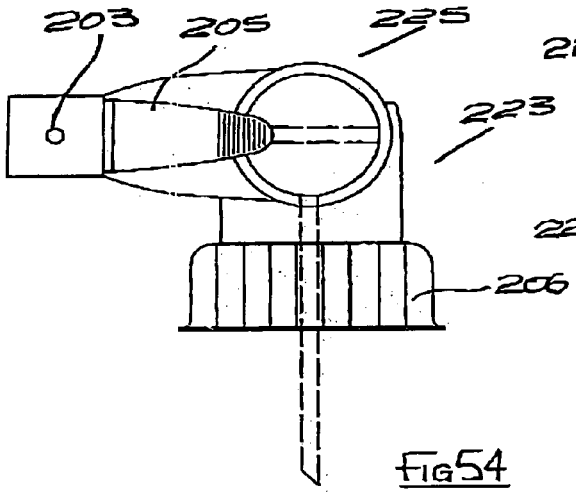
FIG. 54 is an end view of the trigger sprayer of FIG. 53 in the folded position.
Figure 53:
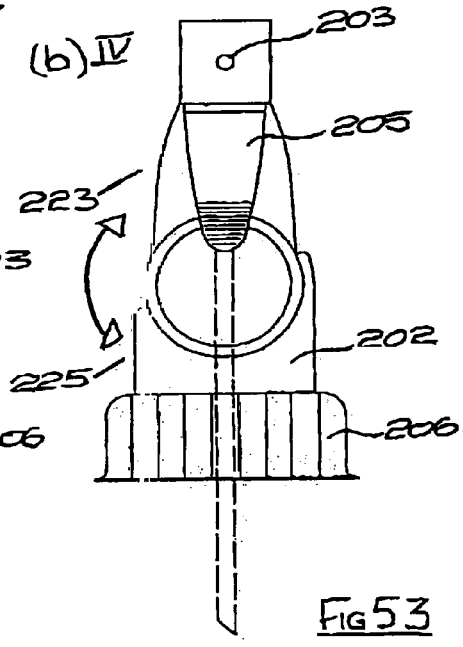
FIG. 53 is an end view of another trigger sprayer.

FIGS. 53 and 54 show an alternative construction of trigger sprayer, indicated generally by the reference numeral 223, in which parts similar to those described with reference to FIG. 52, are identified by the same reference numerals. Essentially, they are identical except that the hinge 225 is mounted laterally and it can be seen from FIG. 54 how it pivots.

Figure 55:
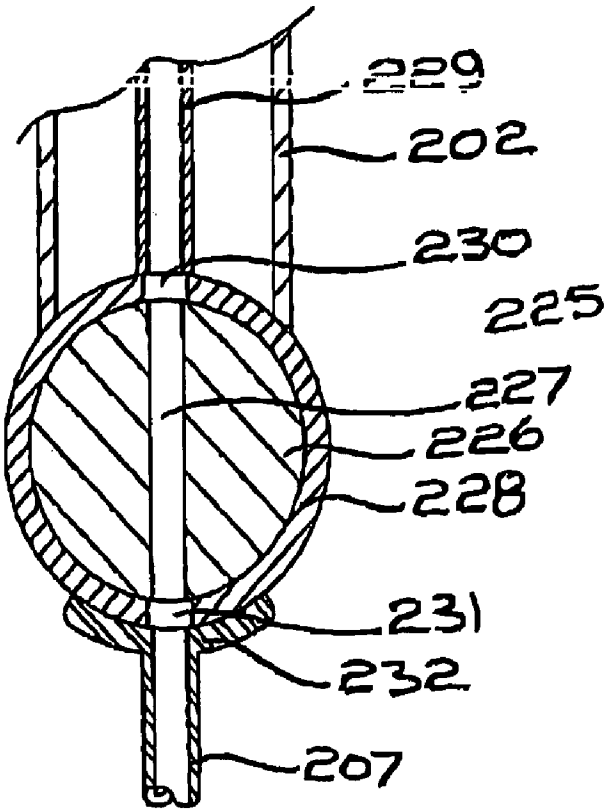
FIG. 55 is a detailed sectional view of portion of the trigger sprayers of FIGS. 52 to 54.
Figure 56:
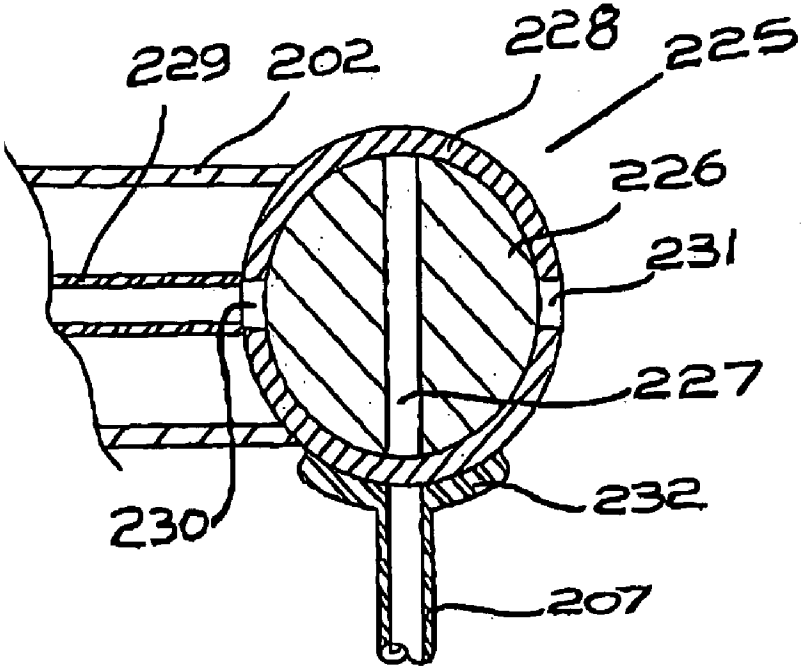
FIG. 56 is a view similar to FIG. 55 showing the hinge of FIG. 55 in a different position.

Referring now to FIGS. 55 and 56, the hinge 225 is illustrated in more detail. In this embodiment, the hinge comprises a cylindrical body 226 having a diametrically arranged delivery bore 227 surrounded by a rotatable sleeve 228 mounting the spray head body 202 and being connected to the pump 204 by a conduit 229 terminating in a hole 230 in the sleeve 228 forming a conduit entrance. The sleeve 228 further carries another hole 231 diametrically opposite to the hole 230 forming a container exit. Mounted against the sleeve 228 by a bearing seal 232 is the container tube 207. As can be seen from FIG. 55, when the holes 230, 231 and the bore 227 coincide, there is a straight through connection for use of the trigger sprayer, while when the trigger sprayer is pivoted to the folded position, the container is sealed.

Figure 57:
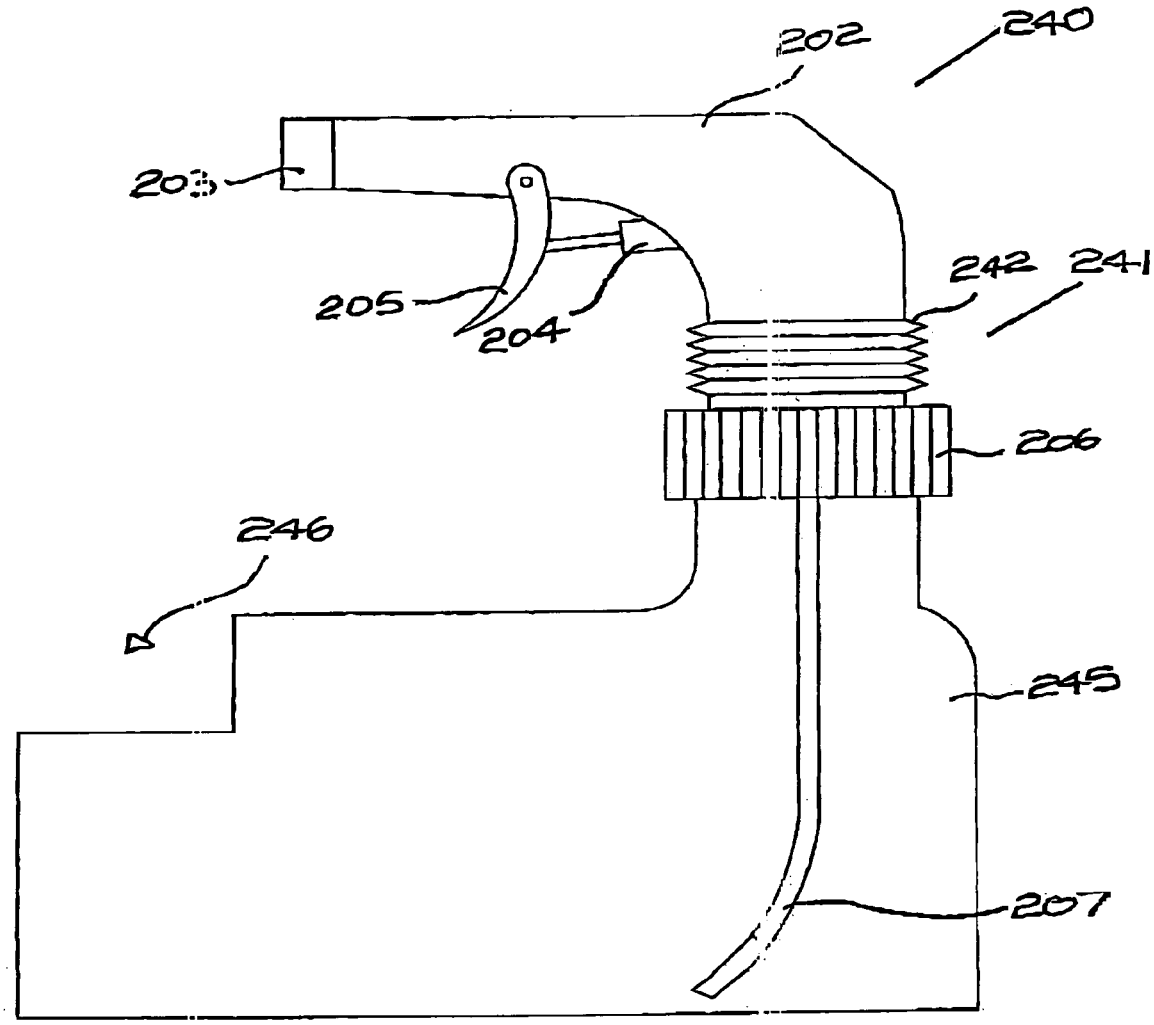
FIG. 57 is a side view of an alternative construction of trigger sprayer according to the invention.

Referring to FIG. 57, there is illustrated an alternative construction of trigger sprayer, indicated generally by the reference numeral 240, in which parts similar to those described with reference to the previous drawings, are identified by the same reference numerals. In this embodiment, there is provided a hinge, indicated generally by the reference numeral 241, formed from concertina-like formations 242 in the spray head body 202. In this embodiment, there is illustrated a squat container 245 having a recess at 246 for reception of the spray head body 202 when the trigger sprayer 240 is folded.

Figure 58:
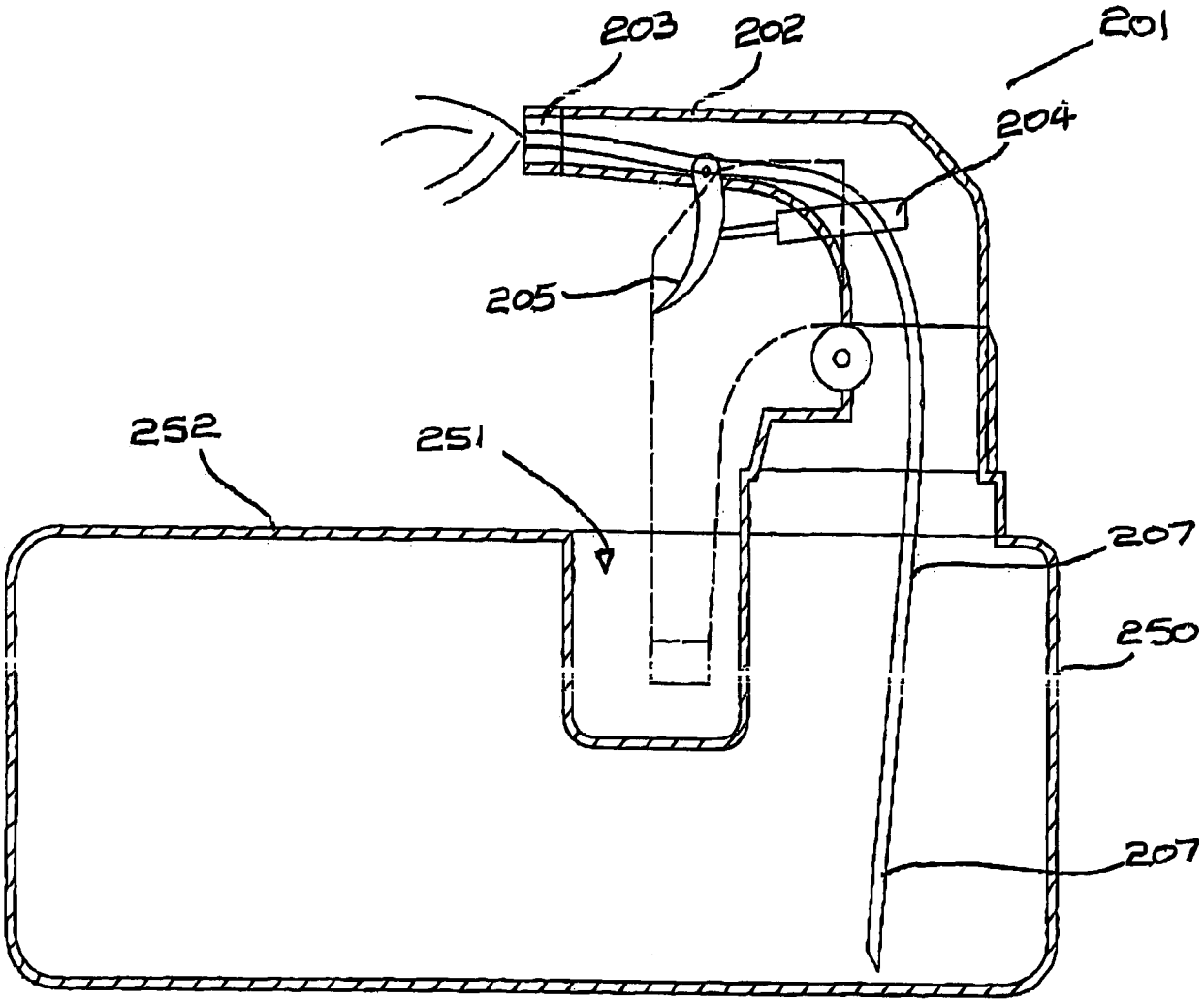
FIG. 58 is a part sectional diagrammatic view of a container and trigger sprayer according to the invention.

Referring now to FIG. 58, there is illustrated the trigger sprayer of FIG. 50 mounted on a container 250 having a recess 251 in its top wall 252 for reception of the trigger sprayer 201.

Figure 59:
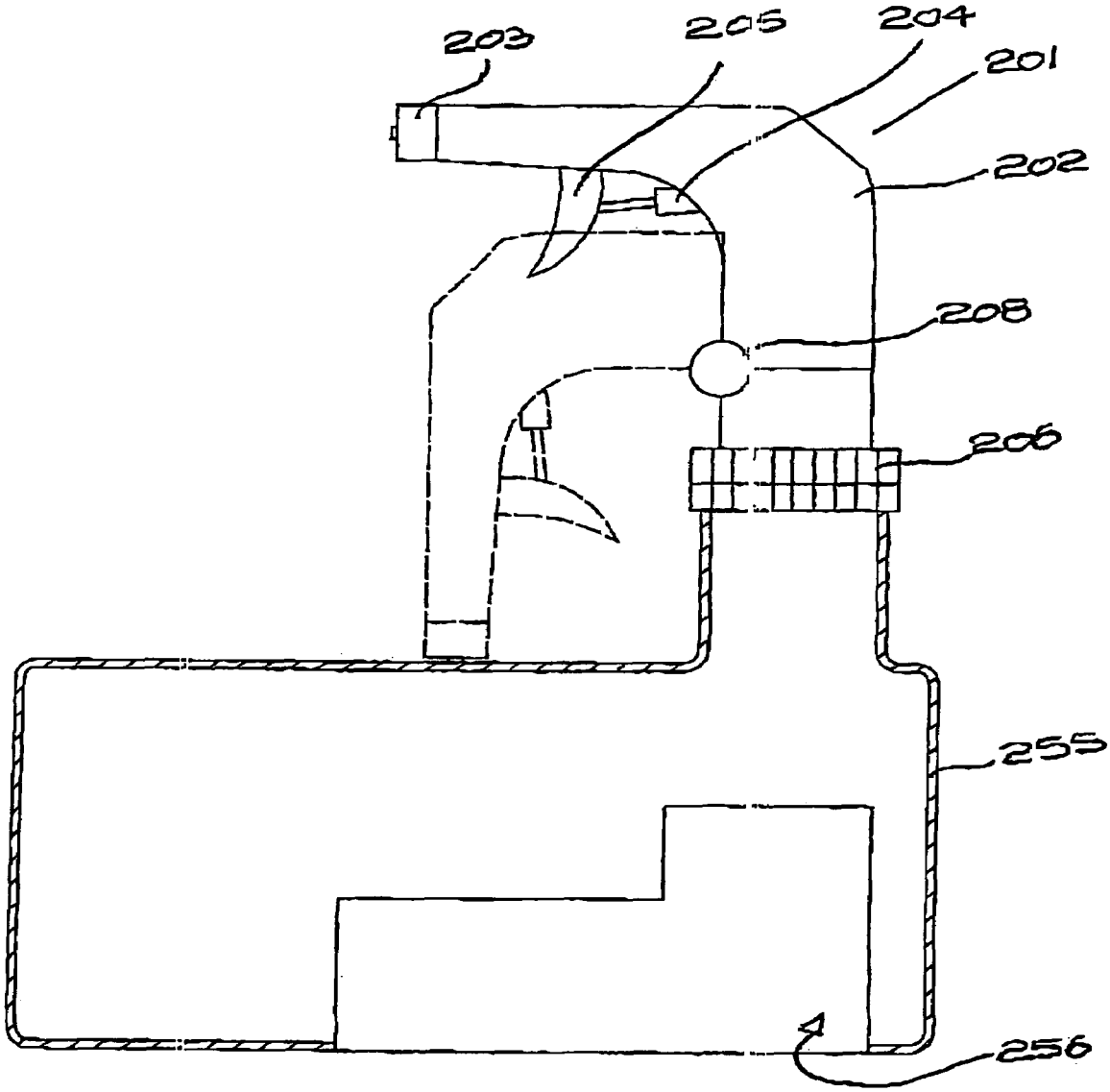
FIG. 59 is a view similar to FIG. 58 of another container and trigger sprayer according to the invention.

FIG. 59 illustrates a still further construction of container, indicated generally by the reference numeral 255, having a recess 256 in its bottom wall whereby, on the trigger sprayer 201 being pivoted downwards as shown by the interrupted lines, the trigger sprayer 201 will be stored within a container 255 mounted on top of it.

Figure 60:
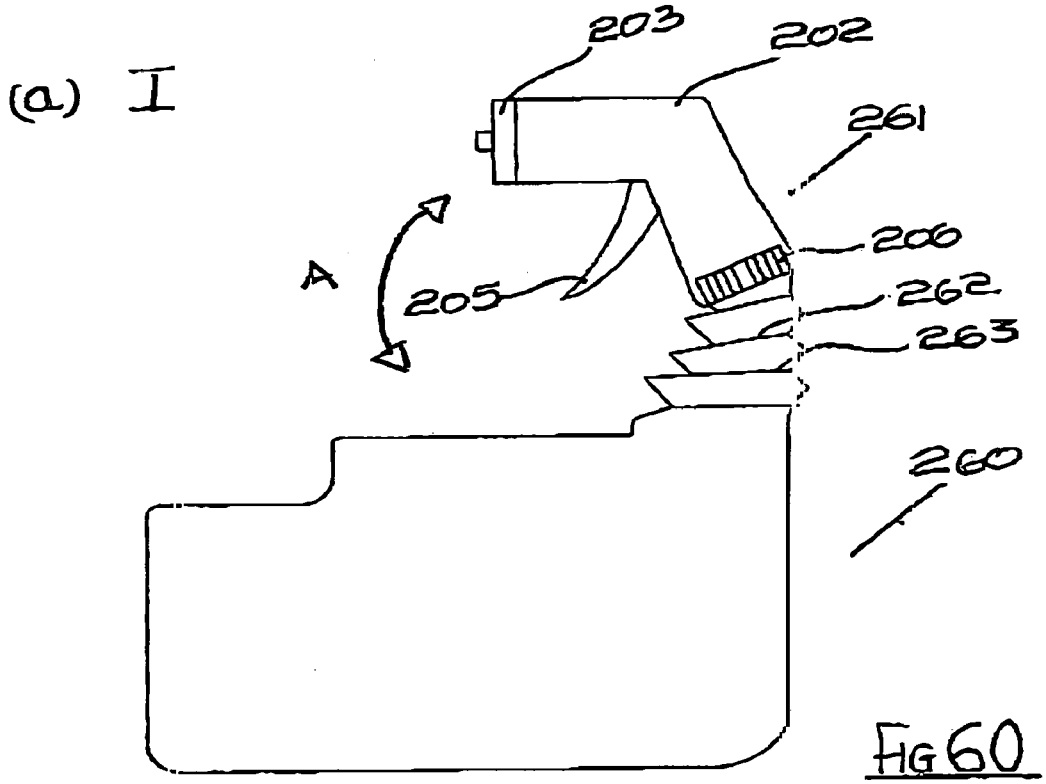
FIG. 60 is a side view of an alternative construction of container according to the invention.
Figure 61:
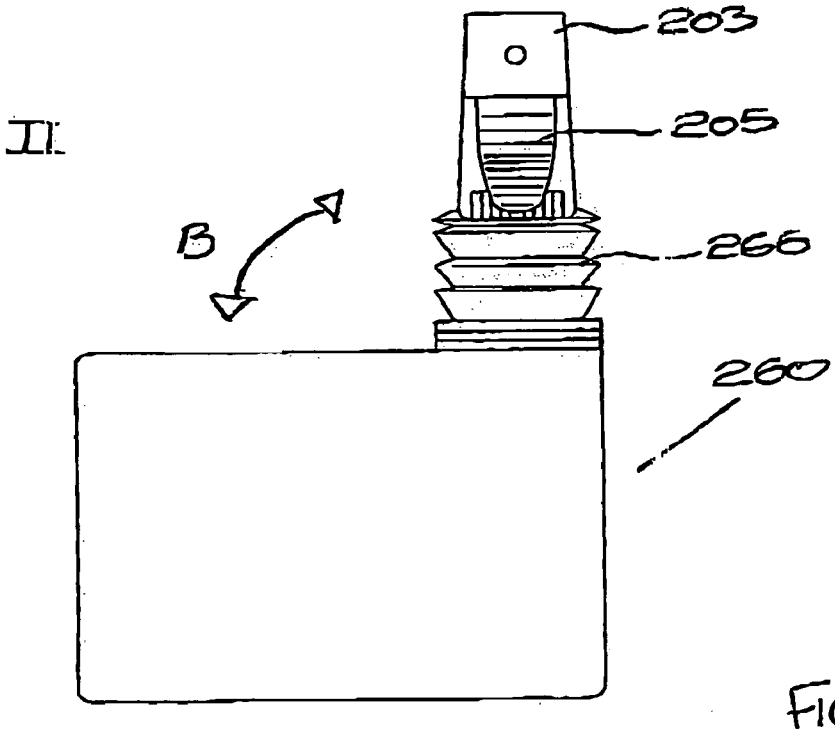
FIG. 61 is an end view of the container of FIG. 60.

Referring to FIGS. 60 and 61, there is illustrated a container, indicated generally by the reference numeral 260, for mounting a conventional trigger sprayer, indicated generally by the reference numeral 261, in which parts similar to those described with reference to the previous drawings, are identified by the same reference numerals. In this embodiment, the container 260 has a neck 262 having concertina-like folds 263 which permit it to fold in either the direction of the arrows A of FIG. 60 or in the direction of the arrows B of FIG. 61.

Figure 63:
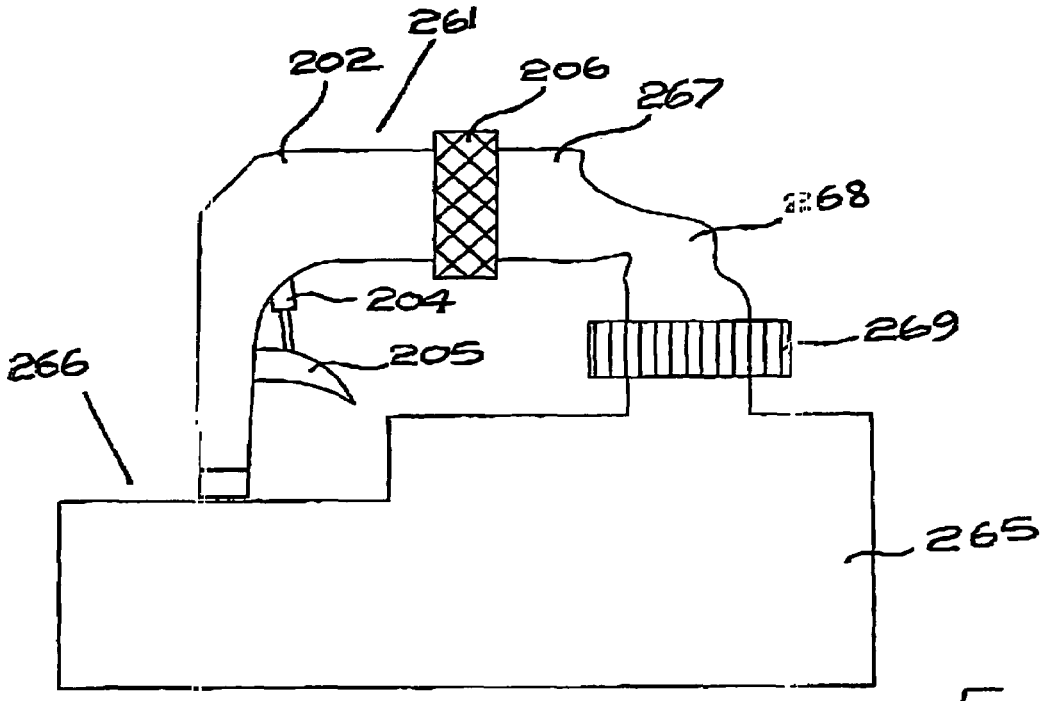
FIG. 63 is a side view of the container showing the trigger sprayer of FIG. 62 in the folded position.
Figure 62:
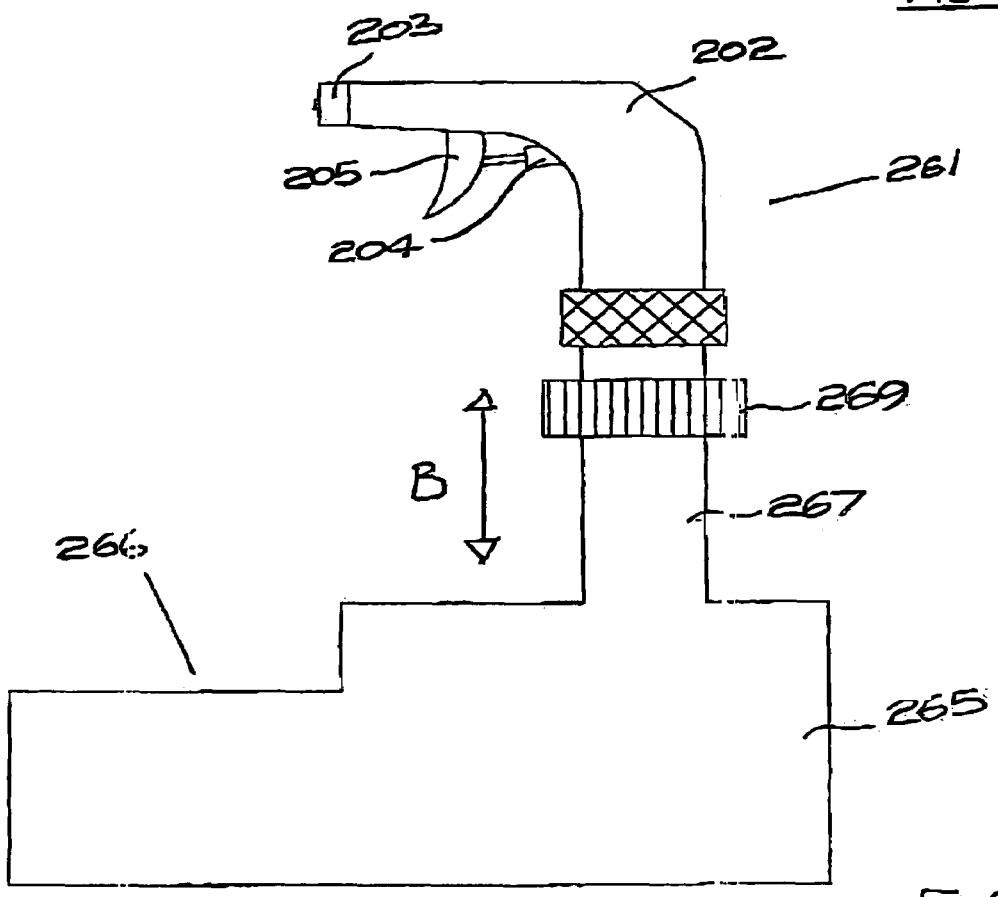
FIG. 62 is a die view of an alternative construction of container according to the invention with a trigger sprayer attached to it.

Referring now to FIGS. 62 and 63, there is provided again the conventional trigger sprayer 261 mounted on a container 265 having a recess 266 in its top wall and a neck portion 267 incorporating a weakened portion 268 and a sleeve 269 slidable into the position as illustrated in FIG. 62 where it covers the weakened portion 268 to allow the trigger sprayer 261 to operate in a conventional manner while, when moved in the direction of the arrow B to the position illustrated in FIG. 63, the weakened portion 268 is exposed and the trigger sprayer 201 can be folded into the recess 256.

Figure 64:
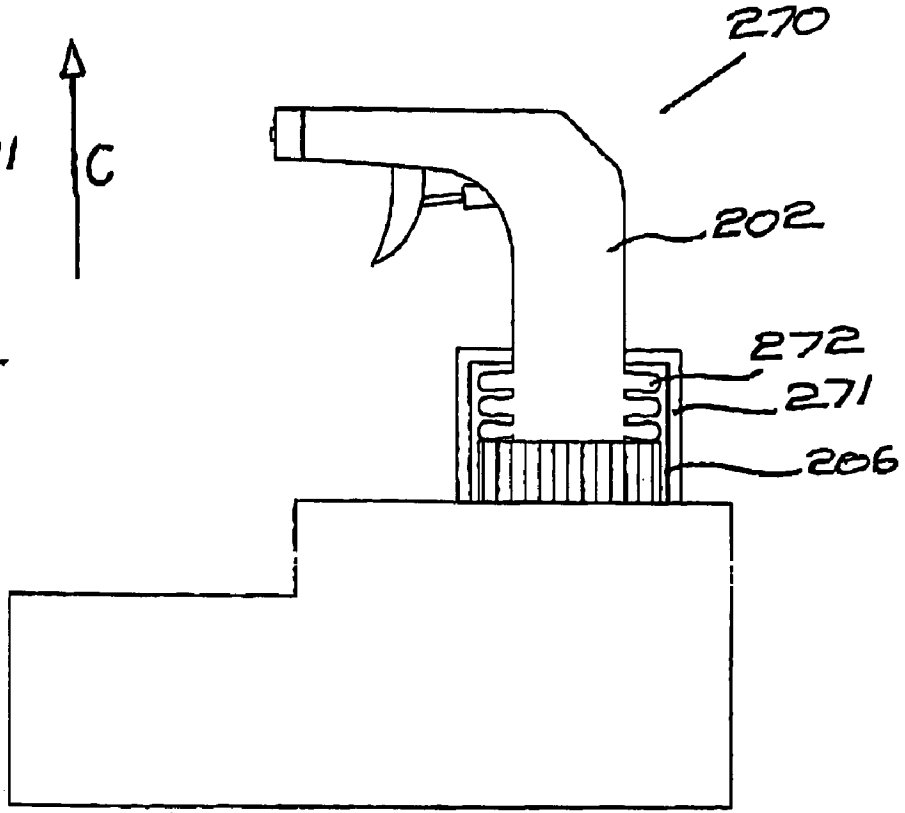
FIG. 64 is a side view of an alternative construction of trigger sprayer according to the invention.
Figure 65:
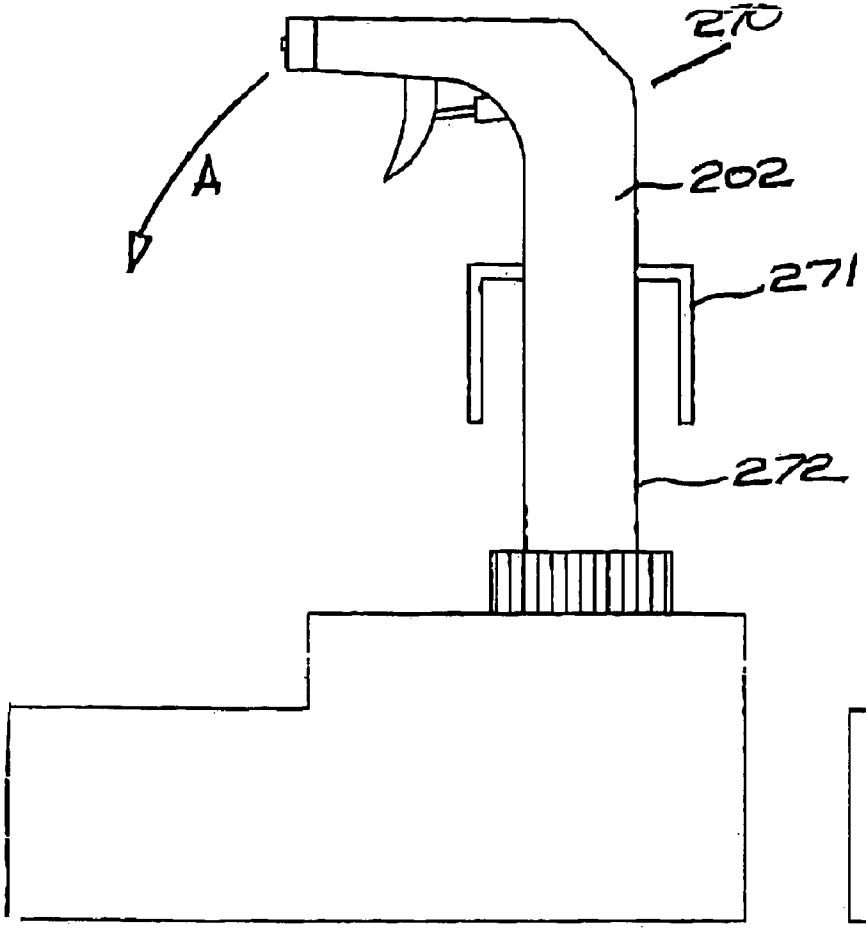
FIG. 65 is a view of the trigger sprayer of FIG. 64 in an extended position about to be folded.

Referring to FIGS. 64 and 65, there is illustrated a still further construction of trigger sprayer, indicated generally by the reference numeral 270, in which parts similar to those described with reference to the previous drawings, are identified by the same reference numerals. In this embodiment, the spray head body 202 mounts a rigid sleeve 271. The spray head body 202 is weakened at 272. Thus, it can be seen when the sleeve 271 is engaged on the cap 206, the weakened portion 272 is folded between the sleeve 271 and the cap 206 and thus the trigger sprayer 270 can be used in conventional manner. However, when the sleeve 271 is retracted upwards in the direction of the arrow C, the weakened portion 272 is now exposed and the trigger sprayer 270 can be folded in the direction of the arrow A.

It will be appreciated that all of the various container assemblies shown advantageously are very stable in use and can be stacked for storage, on display shelving for example, and for transport and also are very space efficient, in that the space occupied by the sprayers has a very high percentage usable volume of contents.

It will also be noted that the improved stability of the containers of the invention facilitates easier and quicker filling on a production line. Further, in view of the more compact construction of the container of the invention, less material is used to provide a container of a given volume. This provides savings in the manufacture of containers and reduces the environmental problem of disposing or recycling of used containers.

The trigger sprayer may be attached to the container in any suitable fashion, either by a removable attachment or possibly by a permanent attachment such as by welding or gluing for example.

Where a separate filling hole is provided in the container this provides the possibility of attaching the trigger sprayer to the container prior to filling the container which may provide greater convenience and cost savings in respect of filling the containers.

In the specification the terms "comprise, comprises, and comprised and comprising" or any variation thereof and the terms "include, includes, included and including" or any variation thereof are considered to be totally interchangeable and they should all be afforded the widest possible interpretation.

The invention is not limited to the embodiments hereinbefore described but may be varied in both construction and detail within the scope of the appended claims.

The invention claimed is:

1. A trigger sprayer container assembly comprising:

a container, a trigger sprayer mounted on the container and communicating with an interior of the container for dispensing liquid from the container, the container having a generally parallelepiped shape in which a ratio of a width of a base of the container at a narrowest point to a height of the container is in a range 2:1 to 1:3 , the trigger sprayer being mounted on the container such that a top surface of the container in combination with an uppermost surface of the trigger sprayer together form a support surface for reception and support of another similar trigger sprayer container assembly stacked thereon.

2. The trigger sprayer container assembly as claimed in claim 1 wherein the container has a substantially cubic shape.

3. The trigger sprayer container assembly as claimed in claim 1 wherein the ratio of the cross-sectional area of the base to the cross-sectional area of a side wall of the container is in the range 2:1to 1:2.

4. The trigger sprayer container assembly as claimed in claim 3 wherein the ratio is about 1:1.

5. The trigger sprayer container assembly as claimed in claim 1 wherein the volume of the container relative to the spatial volume occupied by the container, said spatial volume being defined by an imaginary parallelepiped inside faces of which touch corresponding external side faces of the container is greater than 60%.

6. The trigger sprayer container assembly as claimed in claim 5 wherein the relative volume is greater than 75%.

7. The trigger sprayer container assembly as claimed in claim 5 wherein the relative volume is greater than 90%.

8. The trigger sprayer container assembly as claimed in claim 1 wherein the trigger sprayer is mounted at a top of the container offset from a center of the top of the container sufficiently to allow stacking of a pair of mutually inverted trigger sprayer assemblies with said trigger sprayers resting side by side and the trigger sprayer on each container engaging the top of the other adjacent container.

9. A The trigger sprayer container assembly as claimed in claim 1 wherein the trigger sprayer is mounted at a top of the container and means for mounting the trigger sprayer on the container is provided which supports a spray head of the trigger sprayer in a substantially horizontal position extending across and spaced-above the top of the container.

10. The trigger sprayer container assembly as claimed in claim 1 wherein the container has a lower portion and an upper portion extending upwardly of the lower portion and defining with the lower portion a recess within which the trigger sprayer is mounted with an uppermost portion of the trigger sprayer being substantially flush with a top of the upper portion of the container.

11. The trigger sprayer container assembly as claimed in claim 10 wherein the container is generally L-shaped in cross-section, the upper portion extending upwardly at one side of the lower portion of the container.

12. The trigger sprayer container assembly as claimed in claim 10 wherein the trigger sprayer is mounted on a top surface of the lower portion of the container and is spaced-apart from an upstanding side wall of the upper portion sufficiently to allow insertion and through passage of the fingers or thumb of a person's hand for gripping the trigger sprayer.

13. The trigger sprayer container assembly as claimed in claim 12 wherein the ends of the upper portion are flared or curved to provide easy access to the trigger sprayer.

14. The trigger sprayer container assembly as claimed in claim 10 wherein the trigger sprayer is mounted on the top surface of the lower portion of the container closely adjacent to the upstanding side wall of the upper portion so that in use a user grips both the trigger sprayer and the upper portion when using the trigger sprayer.

15. The trigger sprayer container assembly as claimed in claim 1 wherein the trigger sprayer is mounted on the container in a manner which allows the trigger sprayer to be swivelled on the container while at the same time allowing it to be locked in any desired position of use.

16. The trigger sprayer container assembly as claimed in claim 10 wherein a filling opening is provided in the top of the upper portion which is closed by a sealing cap.

17. The trigger sprayer container assembly as claimed in claim 1 wherein the trigger sprayer is pivotally mounted on a side wall of the container for pivotal movement between a flattened stored position against the side wall and an outwardly extending in-use position projecting outwardly of the side wall.

18. The trigger sprayer container assembly as claimed in claim 17 wherein the trigger sprayer is attached by a pivoting neck to the side wall of the container so that it will pivot outwardly through about 90° between the stored position and an extended in-use position.

19. A trigger sprayer container assembly comprising a container with a trigger sprayer mounted on the container and communicating with an interior of the container for dispensing liquid from the container, the trigger sprayer being mounted on the container such that a top surface of the container in combination with an uppermost surface of the trigger sprayer together form a support surface for reception and support of another similar trigger sprayer container assembly stacked thereon.

20. The trigger sprayer container assembly as claimed in claim 19 wherein the uppermost surface of the trigger sprayer is substantially flush with the top surface of the container.

21. The trigger sprayer container assembly as claimed in claim 19 wherein the trigger sprayer is mounted at one side of the container.

22. the trigger sprayer container assembly as claimed in claim 19 wherein the trigger sprayer is mounted within a stepped recess in an upper portion of the container.

23. The trigger sprayer container assembly as claimed in claim 22 wherein the trigger sprayer is mounted in an upright orientation within the recess.

24. The trigger sprayer container assembly as claimed in claim 22 wherein the trigger sprayer is mounted in a generally horizontal orientation within the recess.

25. A trigger sprayer container assembly comprising a container with a trigger sprayer mounted on the container and communicating with an interior of the container for dispensing liquid from the container, the trigger sprayer being mounted at a top of the container offset from a center of the top of the container sufficiently to allow stacking of a pair of mutually inverted trigger sprayer assemblies with said trigger sprayers resting side by side and the trigger sprayer on each container engaging the top of the other adjacent container.

26. The trigger sprayer container assembly as claimed in claim 1 wherein the container has a lower portion and an upper portion, the two portions defining a recess at the top of the container within which the trigger spray is mounted.

27. The trigger sprayer container assembly as claimed in claim 26 wherein the trigger spray is mounted on top of the lower portion upstanding beside the upper portion.

28. The trigger sprayer container assembly as claimed in claim 26 wherein the trigger spray is mounted on a side of the upper portion projecting outwardly over the top of the lower portion.

* * * * *